US008002950B2

(12) United States Patent
Quigley

(10) Patent No.: US 8,002,950 B2
(45) Date of Patent: Aug. 23, 2011

(54) STRUCTURED FABRIC FOR PAPERMAKING AND METHOD

(75) Inventor: Scott Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 564 days.

(21) Appl. No.: 12/155,863

(22) Filed: Jun. 11, 2008

(65) Prior Publication Data

US 2009/0308558 A1 Dec. 17, 2009

(51) Int. Cl.
*D21F 1/10* (2006.01)
*D03D 3/04* (2006.01)

(52) U.S. Cl. ..... 162/348; 162/903; 162/116; 139/383 A

(58) Field of Classification Search ..... 162/348, 162/902, 903, 904, 116, 362; 139/383 A, 139/425 A See application file for complete search history.

(56) References Cited

U.S. PATENT DOCUMENTS

| | | | |
|---|---|---|---|
| 3,867,766 | A | 2/1975 | Wagner |
| 4,191,609 | A | 3/1980 | Trokhan |
| 4,224,372 | A | 9/1980 | Romanski |
| 4,239,065 | A | 12/1980 | Trokhan |
| 4,314,589 | A | 2/1982 | Buchanan et al. |
| 4,423,755 | A | 1/1984 | Thompson |
| 4,501,303 | A | 2/1985 | Osterburg |
| 4,564,052 | A | 1/1986 | Borel |
| 4,759,391 | A | 7/1988 | Waldvogel et al. |
| 4,832,090 | A | 5/1989 | Krenkel et al. |
| 5,101,866 | A | 4/1992 | Quigley |
| 5,151,316 | A | 9/1992 | Durkin et al. |
| 5,152,326 | A | 10/1992 | Vohringer |
| 5,324,248 | A | 6/1994 | Quigley |
| 5,343,896 | A | 9/1994 | Schroder et al. |
| 5,429,686 | A | 7/1995 | Chiu et al. |
| 5,437,315 | A | 8/1995 | Ward |
| 5,456,293 | A | 10/1995 | Ostermayer et al. |
| 5,520,225 | A | 5/1996 | Quigley et al. |
| 5,542,455 | A | 8/1996 | Ostermayer et al. |
| 5,555,917 | A | 9/1996 | Quigley |
| 5,694,980 | A | 12/1997 | Quigley |
| 5,713,397 | A | 2/1998 | Quigley |
| 5,731,059 | A | 3/1998 | Smith et al. |
| 5,817,213 | A | 10/1998 | Ostermayer et al. |
| 5,826,627 | A | 10/1998 | Seabrook et al. |
| 5,840,411 | A | 11/1998 | Stelljes, Jr. et al. |
| 5,853,547 | A | 12/1998 | Ahrens et al. |

(Continued)

FOREIGN PATENT DOCUMENTS

| | | |
|---|---|---|
| WO | 02/00996 | 1/2002 |

(Continued)

OTHER PUBLICATIONS

U.S. Appl. No. 11/896,847, filed Sep. 6, 2007.

(Continued)

*Primary Examiner* — Eric Hug
(74) *Attorney, Agent, or Firm* — Greenblum & Bernstein, P.L.C.

(57) ABSTRACT

Fabric for making a bulky web. The fabric includes a machine facing side and a web facing side comprising pockets formed by more MD yarns than CD yarns. Adjacent pockets are offset from each other and are defined by MD and CD knuckles. This Abstract is not intended to define the invention disclosed in the specification, nor intended to limit the scope of the invention in any way.

36 Claims, 15 Drawing Sheets

U.S. PATENT DOCUMENTS

| | | | | |
|---|---|---|---|---|
| 5,945,357 | A | 8/1999 | Quigley | |
| 5,967,195 | A | 10/1999 | Ward | |
| 5,988,229 | A | 11/1999 | Quigley | |
| 6,148,869 | A | 11/2000 | Quigley | |
| 6,202,705 | B1 | 3/2001 | Johnson et al. | |
| 6,227,256 | B1 | 5/2001 | Quigley | |
| 6,237,644 | B1 | 5/2001 | Hay et al. | |
| 6,349,749 | B1 | 2/2002 | Quigley | |
| 6,530,398 | B1 | 3/2003 | Westerkamp | |
| 6,546,964 | B1 | 4/2003 | Westerkamp | |
| 6,581,645 | B1 | 6/2003 | Johnson et al. | |
| 6,592,714 | B2 | 7/2003 | Lamb | |
| 6,649,026 | B2 | 11/2003 | Lamb | |
| 6,834,684 | B2 | 12/2004 | Martin et al. | |
| 6,860,299 | B2 | 3/2005 | Kuji | |
| 6,926,043 | B2 | 8/2005 | Quigley et al. | |
| 6,953,065 | B2 | 10/2005 | Martin et al. | |
| 6,959,737 | B2 | 11/2005 | Ward | |
| 6,978,809 | B2 | 12/2005 | Quigley | |
| 7,007,722 | B2 | 3/2006 | Quigley et al. | |
| 7,048,012 | B2 | 5/2006 | Martin et al. | |
| 7,059,357 | B2 | 6/2006 | Ward | |
| 7,059,359 | B2 | 6/2006 | Quigley et al. | |
| 7,493,923 | B2 * | 2/2009 | Barrett et al. | 139/383 A |
| 7,585,395 | B2 * | 9/2009 | Quigley et al. | 162/358.4 |
| 7,879,193 | B2 | 2/2011 | Quigley | |
| 7,879,194 | B2 | 2/2011 | Quigley | |
| 7,879,195 | B2 | 2/2011 | Quigley | |
| 2002/0056536 | A1 | 5/2002 | Lamb | |
| 2004/0020621 | A1 | 2/2004 | Heger et al. | |
| 2004/0079434 | A1 | 4/2004 | Martin et al. | |
| 2004/0182465 | A1 | 9/2004 | Ward | |
| 2004/0231745 | A1 | 11/2004 | Quigley et al. | |
| 2004/0238062 | A1 | 12/2004 | Quigley et al. | |
| 2005/0051230 | A1 | 3/2005 | Martin et al. | |
| 2005/0067040 | A1 | 3/2005 | Quigley | |
| 2005/0103397 | A1 | 5/2005 | Quigley et al. | |
| 2005/0139281 | A1 | 6/2005 | Martin et al. | |
| 2005/0167066 | A1 | 8/2005 | Herman et al. | |
| 2006/0009582 | A1 | 1/2006 | Zhang et al. | |
| 2006/0016505 | A1 | 1/2006 | Westerkamp | |
| 2006/0016509 | A1 | 1/2006 | Westerkamp | |
| 2006/0048840 | A1 | 3/2006 | Quigley | |
| 2006/0060321 | A1 | 3/2006 | Quigley et al. | |
| 2006/0063451 | A1 | 3/2006 | Serr et al. | |
| 2006/0085999 | A1 | 4/2006 | Scherb et al. | |
| 2006/0219312 | A1 | 10/2006 | Hay et al. | |
| 2006/0243338 | A1 | 11/2006 | Hawes et al. | |
| 2006/0278294 | A1 | 12/2006 | Quigley | |
| 2007/0006934 | A1 | 1/2007 | Quigley et al. | |
| 2007/0006935 | A1 | 1/2007 | Quigley et al. | |
| 2007/0028996 | A1 | 2/2007 | Quigley | |
| 2007/0215304 | A1 | 9/2007 | Fernandes et al. | |
| 2007/0240842 | A1 | 10/2007 | Scherb et al. | |
| 2007/0251659 | A1 | 11/2007 | Fernandes et al. | |
| 2007/0251660 | A1 | 11/2007 | Walkenhaus et al. | |
| 2007/0272385 | A1 | 11/2007 | Quigley et al. | |

FOREIGN PATENT DOCUMENTS

| | | |
|---|---|---|
| WO | 03/062528 | 7/2003 |
| WO | 2005/025736 | 3/2005 |
| WO | 2005/035867 | 4/2005 |
| WO | 2005/075732 | 8/2005 |
| WO | 2005/075737 | 8/2005 |
| WO | 2006/113818 | 10/2006 |

OTHER PUBLICATIONS

U.S. Appl. No. 11/896,842, filed Sep. 6, 2007.

* cited by examiner

| | | | | | | | | |
|---|---|---|---|---|---|---|---|---|
| X | | | X | X | | | X | 8 |
| X | | X | | X | | X | | 7 |
| X | X | | | X | X | | | 6 |
| | X | | X | | X | | X | 5 |
| | X | X | | | X | X | | 4 |
| X | | X | | X | | X | | 3 |
| | | X | X | | | X | X | 2 |
| | X | | X | | X | | X | 1 |
| 1 | 2 | 3 | 4 | 5 | 6 | 7 | 8 | |

PRIOR ART

PRIOR ART

STRAIGHT TWILL G WEAVE

PRIOR ART

STRUCTURED FABRIC FOR PAPERMAKING AND METHOD

BACKGROUND OF THE INVENTION

1. Field of the Invention

The present invention relates generally to papermaking, and relates more specifically to a structured fabric employed in papermaking. The invention also relates to a structured fabric having deep pockets. The fabric may be used as a forming fabric, as a TAD (through air drying) fabric, as a Crepe fabric, and/or as a transfer fabric. The fabric may also be utilized in a conventional TAD (through air drying) machine or system, an ATMOS™ system, and/or an E-TAD system or machine.

2. Discussion of Background Information

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

In a conventional tissue forming machine, the sheet is formed flat. At the press section, 100% of the sheet is pressed and compacted to reach the necessary dryness and the sheet is further dried on a Yankee and hood section. This, however, destroys the sheet quality. The sheet is then creped and wound-up, thereby producing a flat sheet.

In an ATMOS system, a sheet is formed on a structured or molding fabric and the sheet is further sandwiched between the structured or molding fabric and a dewatering fabric. The sheet is dewatered through the dewatering fabric and opposite the molding fabric. The dewatering takes place with air flow and mechanical pressure. The mechanical pressure is created by a permeable belt and the direction of air flow is from the permeable belt to the dewatering fabric. This can occur when the sandwich passes through an extended pressure nip formed by a vacuum roll and the permeable belt. The sheet is then transferred to a Yankee by a press nip. Only about 25% of the sheet is slightly pressed by the Yankee while approximately 75% of the sheet remains unpressed for quality. The sheet is dried by a Yankee/Hood dryer arrangement and then dry creped. In the ATMOS system, one and the same structured fabric is used to carry the sheet from the headbox to the Yankee dryer. Using the ATMOS system, the sheet reaches between about 35 to about 38% dryness after the ATMOS roll, which is almost the same dryness as a conventional press section. However, this advantageously occurs with almost 40 times lower nip pressure and without compacting and destroying sheet quality. Furthermore, a big advantage of the ATMOS system is that it utilizes a permeable belt which is highly tensioned, e.g., about 60 kN/m. This belt enhances the contact points and intimacy for maximum vacuum dewatering. Additionally, the belt nip is more than 20 times longer than a conventional press and utilizes air flow through the nip, which is not the case on a conventional press system.

Actual results from trials using an ATMOS system have found that the caliper and bulk of the sheet is 30% higher than the conventional through air drying (TAD) formed towel fabrics. Absorbency capacity is also 30% higher than with conventional TAD formed towel fabrics. The results were the same whether one uses 100% virgin pulp up to 100% recycled pulp. Sheets can be produced with basis weight ratios of between 14 to 40 g/m$^2$. The ATMOS system also provides excellent sheet transfer to the Yankee working at 33 to 37% dryness. There is essentially no dryness loss with the ATMOS system since the fabric has square valleys and not square knuckles (peaks). As such, there is no loss of intimacy between the dewatering fabric, the sheet, the molding fabric, and the belt. A key aspect of the ATMOS system is that it forms the sheet on the molding fabric and the same molding fabric carries the sheet from the headbox to the Yankee dryer. This produces a sheet with a uniform and defined pore size for maximum absorbency capacity.

U.S. patent application Ser. No. 11/753,435 filed on May 24, 2007, the disclosure of which is hereby expressly incorporated by reference in its entirety, discloses a structured forming fabric for an ATMOS system. The fabric utilizes an at least three float warp and weft structure which, like the prior art fabrics, is symmetrical in form.

U.S. patent application Ser. No. 11/896,847 filed on Sep. 6, 2007, the disclosure of which is hereby expressly incorporated by reference in its entirety, discloses a structured forming fabric for an ATMOS system. The fabric utilizes warp and weft knuckles to define pockets.

U.S. patent application Ser. No. 11/896,842 filed on Sep. 6, 2007, the disclosure of which is hereby expressly incorporated by reference in its entirety, discloses a structured forming fabric for an ATMOS system. The fabric utilizes warp and weft knuckles to define pockets.

U.S. Pat. No. 6,649,026 to LAMB, the disclosure of which is hereby expressly incorporated by reference in its entirety, discloses structured forming fabrics which utilize pockets based on five-shaft designs and with a float of three yarns in both warp and weft (or variations thereof). The fabric is then sanded. However, LAMB does not teach, among other things, using the disclosed fabrics on an ATMOS system and/or forming the pillows in the sheet while the sheet is relatively wet and utilizing a hi-tension press nip.

International Publication No. WO2005/075737 to HERMAN et al. and U.S. patent application Ser. No. 11/380,826 filed on Apr. 28, 2006, the disclosure of which are hereby expressly incorporated by reference in their entireties, disclose structured molding fabrics for an ATMOS system which can create a more three-dimensionally oriented sheet. These documents, however, do not teach, among other things, the deep pock weaves according to the invention.

International Publication No. WO 2005/075732 to SCHERB et al., the disclosure of which is hereby expressly incorporated by reference in its entirety, discloses a belt press utilizing a permeable belt in a paper machine which manufactures tissue or toweling. According to this document, the web is dried in a more efficient manner than has been the case in prior art machines such as TAD machines. The formed web is passed through similarly open fabrics and hot air is blown from one side of the sheet through the web to the other side of the sheet. A dewatering fabric is also utilized. Such an arrangement places great demands on the forming fabric because the pressure applied belt press and hot air is blown through the web in the belt press. However, this document does not teach, among other things, the deep pock weaves according to the invention.

FIGS. 14A-14C show a prior art fabric having an M weave and illustrates the pattern repeat thereof. FIGS. 15A-15C show a prior art fabric having an G weave and illustrates the pattern repeat thereof. FIGS. 16A-16B show a prior art fabric having a straight twill G weave and illustrates the pattern repeat thereof.

The above-noted conventional fabrics limit the amount of bulk that can be built into the sheet being formed due to the fact that they have shallow depth pockets compared to the instant invention. Furthermore, the pockets of the conventional fabrics are merely extensions of the contact areas on the warp and weft yarns.

SUMMARY OF THE INVENTION

According to one non-limiting aspect of the invention, there is provided a structured fabric having a warp and weft structure that is asymmetrical in form. By breaking up the pattern, the invention provides offset pillows and creates a shape that is to some extent diagonal. This has can improve the performance of the system in terms of on-machine drying efficiency.

According to another non-limiting aspect of the invention, there is provided a structured fabric that provides increased caliper, bulk, and absorbency in tissue and toweling.

According to another non-limiting aspect of the invention, there is provided at least one weave design/configuration wherein warp impressions are utilized to provide deep pockets at optimum frequency compared to conventional fabrics. The pockets are deeper than those of conventional fabrics because they have bottoms which are arranged on a plane lower than the contact level which borders the pocket on two sides. The floors or bottoms of the pockets can also be formed by a plain weave in a weft direction.

According to another non-limiting aspect of the invention, the weave design/configuration of the invention can be used on conventional TAD systems, on an ATMOS system, on an E-TAD (i.e., a proprietary process of Georgia-Pacific) system, and/or on Metso systems.

According to another non-limiting aspect of the invention, the weave design/configuration of the invention can be used on a structured forming fabric, on a TAD (through air drying) fabric, on a Crepe fabric, and/or on a transfer fabric.

According to another non-limiting aspect of the invention, the forming fabric of the invention is used on an ATMOS system. By dewatering from the belt press belt of the ATMOS system towards the web, structured fabric and the dewatering belt, contact area at the Yankee is enhanced and a higher dryer efficiency results at the Yankee. This is because the surface of the web which contacts the dewatering belt is the same surface which contacts the Yankee. Using such a configuration results in, among other things, a higher contact area between the paper web and the Yankee cylinder than is normally achieved using a through air drying (TAD) system.

According to another non-limiting aspect of the invention, the fabric of the invention is used on an E-TAD system or machine as the fabric which receives the web after the web is transferred to a heated dryer roll from a press felt. The fabric then transfers the web to a Yankee roll. The fabric preferably runs at a slower speed than the heated dryer roll which transfers the web from the press felt to the fabric leading to the Yankee roll.

According to another non-limiting aspect of the invention, the weave designs/configurations of the invention can utilize shaped yarns, as well as a wide range of meshes, counts, permeabilities, yarn diameters and number of pockets per square inch as will be specified herein.

According to another non-limiting aspect of the invention, there is provided a fabric for the manufacture of bulky tissue and/or toweling wherein the fabric comprises a plurality of substantially equally sized pockets formed by having a warp and weft interchange such that the pockets are generally rectangular with a width measured in a weft direction being longer than a height measured in the warp direction.

According to another non-limiting aspect of the invention, there is provided a fabric for the manufacture of bulky tissue and/or toweling wherein the fabric comprises a plurality of substantially equally sized pockets formed by having a warp and weft interchange such that the pockets are generally rectangular with a width measured in a weft direction defined by five warp yarns and a height defined by three weft yarns.

According to another non-limiting aspect of the invention, there is provided a fabric for the manufacture of bulky tissue and/or toweling wherein the fabric comprises a plurality of substantially equally sized non-square pockets formed by having a minimum of two planes of warp and weft interchange such that in the upper plane of the fabric, the pockets are surrounded by warp and weft yarns, and the bottom plane can, in particular, be formed by three warp yarns and one weft yarn.

According to another non-limiting aspect of the invention, there is provided a forming fabric for the manufacture of bulky tissue and/or toweling wherein the fabric produces a tissue or towel sheet with an improved elongated surface shape for the pillows on the sheet, while also maintaining a standard pocket size thereby providing improved machine performance.

According to another non-limiting aspect of the invention, there is provided a forming fabric for the manufacture of bulky tissue and/or toweling wherein the fabric has deep pockets formed by a bottom plane having three warp yarns and one weft yarn.

According to another non-limiting embodiment, the fabric utilizes a regular yet offset pattern in the web in order to improve dewatering and drying.

The invention also provides for using the fabric of the invention as a forming fabric of a twin wire ATMOS system which utilizes the belt press belt disclosed in U.S. patent application Ser. No. 11/276,789 filed on Mar. 14, 2006. The disclosure of this U.S. patent application is hereby expressly incorporated by reference in its entirety.

The invention additionally also provides for using the fabric of the invention as a forming fabric of a twin wire ATMOS system which utilizes the dewatering fabric disclosed in U.S. patent application Ser. No. 11/380,835 filed Apr. 28, 2006. The disclosure of this U.S. patent application is hereby expressly incorporated by reference in its entirety.

The invention also provides for a dewatering system for dewatering a web wherein the system includes a twin wire former, a belt press, and a structured fabric according to the invention comprising a paper web facing side, guided over a support surface and through the belt press. The structured fabric runs at a slower speed than a wire of the twin wire former.

The invention also provides for a papermaking system which includes a Crescent former and a machine which transfers the web to a structured fabric according to the invention which in turn transfers the web to a Yankee roll. The structured fabric runs at a slower speed than a belt of the Crescent former.

The structured fabric may be a permeability value of between approximately 100 cfm and approximately 1200 cfm, a paper surface contact area of between approximately 5% and approximately 70% when not under pressure and tension, and an open area of between approximately 10% and approximately 90%.

The structured fabric may comprise one of a single material, a monofilament material, a multifilament material, and two or more different materials.

The structured fabric may be resistant to at least one of hydrolysis and temperatures which exceed 100 degrees C.

The structured fabric may be an endless belt that is at least one of pre-seamed and has its ends joined on a machine which utilizes the belt press.

The web may be at least one of a tissue web, a hygiene web, and a towel web.

The invention also provides for a method of subjecting a fibrous web to pressing in a paper machine using any of the systems described herein, wherein the method comprises forming the fibrous web in the twin wire former and applying pressure to the inventive structured fabric and the fibrous web in the belt press while the web is arranged on the structured forming fabric.

According to another non-limiting aspect of the invention, there is provided a forming fabric for making a bulky web, wherein the fabric comprises a machine facing side and a web facing side comprising pockets formed by warp and weft yarns. The pockets are defined by four sides on an upper plane of the web facing side.

The bulky web may comprise at least one of a tissue web, a hygiene web, and a towel web. The pockets may be substantially equally sized pockets. A bottom of the pockets may be formed by a single plainly weaving weft yarn weaving with three warp yarns. The warp yarns may form warp knuckles that define the upper plane of the fabric. The weft yarns may form weft knuckles that define the upper plane of the fabric. A shape of the pockets may be at least one of non square-shaped and rectangular-shaped.

The fabric may comprise a warp mesh of about 59, a weft count of about 48, a permeability of approximately 573 cfm, and a caliper of approximately 0.0362 inches. The fabric may comprise one of a single material, a monofilament material, a multifilament material, and two or more different materials. The fabric may be resistant to at least one of hydrolysis and temperatures which exceed 100 degrees C. The fabric may be an endless belt that is at least one of pre-seamed and has its ends joined on a machine which utilizes a belt press. The fabric may be structured and arranged to impart a topographical pattern to a web. The fabric may utilize a pattern repeat of eight warp yarns and eight weft yarns. Six of the warp yarns of the pattern repeat may float over three adjacent weft yarns. Each of the warp yarns of the pattern repeat may pass under four weft yarns. None of the warp yarns of the pattern repeat may plainly weave with all eight weft yarns.

The invention also provides for a method of subjecting a web to pressing in a paper machine using the fabric described above, wherein the method comprises forming a web and applying pressure to the fabric and the web. The paper machine may comprise one of a TAD system, an ATMOS system, an E-TAD system, and a Metso system.

The invention also provides for a forming fabric for making a bulky web, comprising a web facing side comprising pockets formed by warp and weft yarns. A contact plane of the web facing side comprises warp and weft knuckles. The warp knuckles are formed by the warp yarns passing over three adjacent weft yarns and the weft knuckles are formed by the weft yarns passing over two adjacent warp yarns.

A bottom of the pockets may comprise a different number of the warp and the weft yarns. The different number of the warp and the weft yarns may comprise three warp yarns and one weft yarn.

Each pocket may be formed by more warp yarns than weft yarns. Each pocket may be formed by five warp yarns and three weft yarns.

The invention also provides for a paper making machine fabric comprising a woven fabric having a weave pattern which is regularly repeated over a surface. Weft yarns, warp yarns, and recesses or pockets open upwardly to a paper supporting side of the fabric. Each of the warp yarns per pattern repeat passes over four weft yarns. Each of the weft yarns per pattern repeat passes over four of the warp yarns.

All of the warp yarns per pattern repeat passes over three adjacent weft yarns. Each of four non-adjacent weft yarns per pattern repeat plainly weaves with the warp yarns. Each of four other non-adjacent weft yarns per pattern pass over two non-adjacent sets of two adjacent warp yarns.

The invention also provides for a paper making machine fabric comprising a woven fabric having a weave pattern repeating over a surface. A pattern square for the repeating pattern contains four warp or MD (machine direction) yarns and eight weft or CD (cross direction) yarns. Warp yarn 1 passes under weft yarns 1-2, over weft yarn 3, under weft yarns 4-5, and over weft yarns 6-8. Warp yarn 2 passes over weft yarn 1, under weft yarns 2-3, over weft yarns 4-6, and under weft yarns 7-8. Warp yarn 3 passes under weft yarn 1, over weft yarns 2-4, under weft yarns 5-6, over weft yarn 7, and under weft yarn 8. Warp yarn 4 passes over weft yarns 1-2, under weft yarns 3-4, over weft yarn 5, under weft yarns 6-7, and over weft yarn 8. Warp yarn 5 passes under weft yarns 1-2, over weft yarn 3, under weft yarns 4-5, and over weft yarns 6-8. Warp yarn 6 passes over weft yarn 1, under weft yarns 2-3, over weft yarns 4-6, and under weft yarns 7-8. Warp yarn 7 passes under weft yarn 1, over weft yarns 2-4, under weft yarns 5-6, over weft yarn 7, and under weft yarn 8. Warp yarn 8 passes over weft yarns 1-2, under weft yarns 3-4, over weft yarn 5, under weft yarns 6-7, and over weft yarn 8.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The present invention relates to a fabric which can be used on a paper machine, a former for manufacturing premium tissue and toweling, a former which utilizes the fabric and a belt press in a paper machine, and/or a fabric which transfers the web to a Yankee roll. The present invention also relates to a crescent and/or a twin wire former for manufacturing premium issue and toweling which utilizes the fabric. The system of the invention is capable of producing premium tissue or toweling with a quality similar to a through-air drying (TAD) but with up to a 40% cost savings.

The present invention also relates to a twin wire former ATMOS system which utilizes a structured fabric which has good resistance to pressure and excessive tensile strain forces, and which can withstand wear/hydrolysis effects that are experienced in an ATMOS system. The system also includes a permeable belt for use in a high tension extended nip around a rotating roll or a stationary shoe and/or which is used in a papermaking device/process, and a dewatering fabric for the manufacture of premium tissue or towel grades without utilizing a through-air drying (TAD) system. The fabric has key parameters which include permeability, weight, caliper, and certain compressibility.

The present invention also relates to machine or system which utilizes the fabric of the invention. By way of non-limiting examples, the fabric can be used on conventional TAD systems, on an ATMOS system, on an E-TAD (i.e., a proprietary process of Georgia-Pacific) system, and/or on Metso systems.

Figures 1A, 1B:
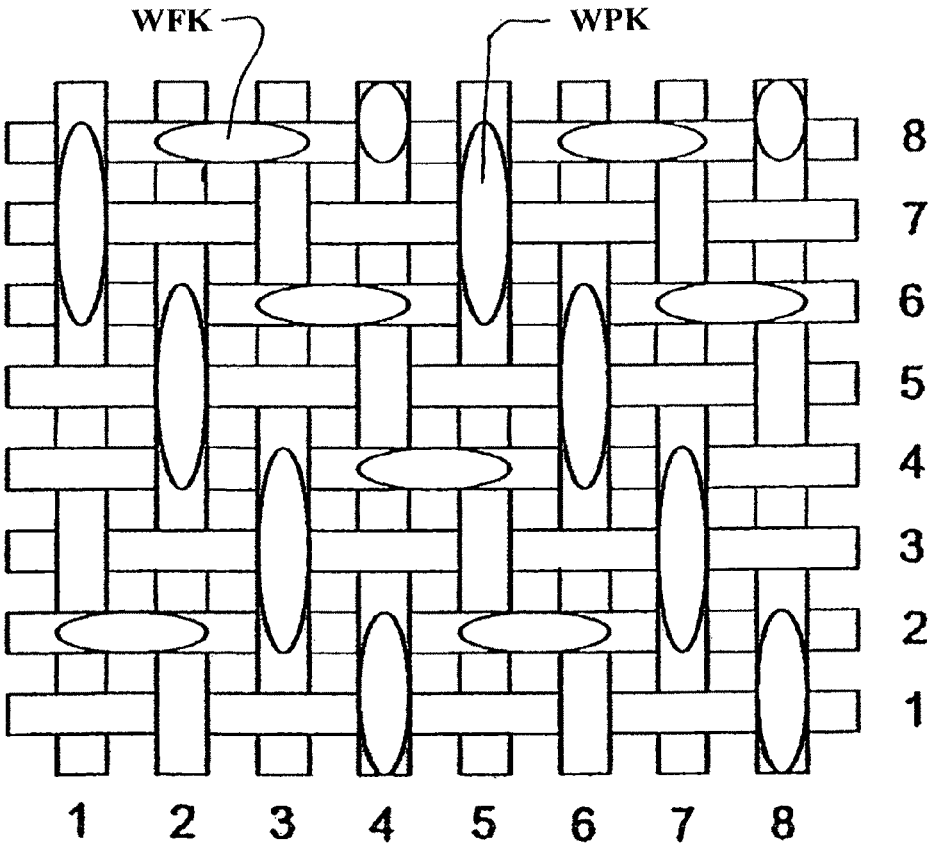
FIG. 1A shows a weave pattern of a non-limiting fabric according to the invention. The pattern repeat includes four warp or MD threads or yarns (numbered horizontally) and eight weft or CD threads or yarns (numbered vertically). The value "X" indicates locations wherein the warp or MD threads pass over weft or CD threads.
FIG. 1B shows a weave pattern of a top side or paper facing side of a non-limiting embodiment of a fabric according to the invention utilizing the fabric repeat of FIG. 1A. The woven pattern repeat includes eight warp or MD threads or yarns (numbered horizontally) and eight weft or CD threads or yarns (numbered vertically)
Figure 1C:
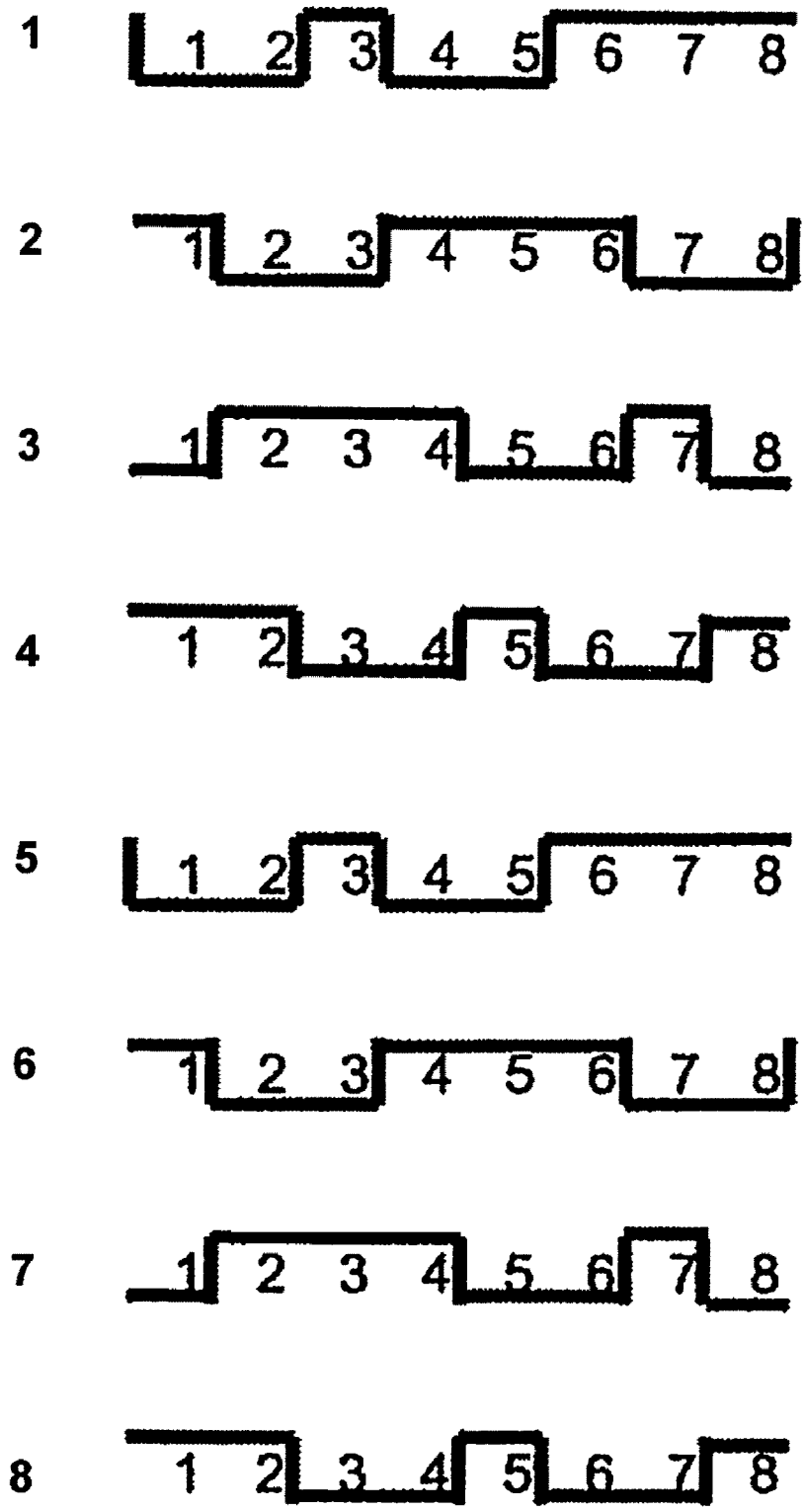
FIG. 1C shows cross-sections of the weave pattern repeat of the forming fabric shown in FIGS. 1A and 1B, and illustrates how each of the eight MD or warp yarns weaves with the eight CD or weft yarns.

One non-limiting embodiment of the structured fabric of the present invention is illustrated in FIGS. 1A-1C. FIG. 1B depicts a top pattern view of the top fabric plane or paper side surface of the fabric (i.e., a view of the papermaking surface). The numbers 1-8 shown horizontally on the bottom of the pattern identify the machine direction (MD) or warp yarns while the right side vertical numbers 1-8 show the cross-direction (CD) or weft yarns. In FIG. 1A, symbol X illustrates locations where warp yarns pass over the weft yarns and empty boxes illustrate locations where warp yarns pass under weft yarns. In FIG. 1B, for example, the area formed between warp yarn 1 and warp yarn 5, and between weft yarn 6 and weft yarn 8, illustrates a pocket area which will form a pillow in a web or sheet. The upper layer of the fabric defines a pocket shape between two warp knuckles WPK and two weft knuckles WFK which can be, e.g., substantially four-sided, and/or rectangular-shaped and non-square.

By way of non-limiting example, the parameters of the fabric shown in FIG. 1B can have a mesh (number of warp yarns per inch) of 42 and a count (number of weft yarns per inch) of 36. The fabric can have a permeability of about 550 cfm and a caliper of about 0.045 inches. The embodiment shown in FIG. 1A-1C also results in deep pockets formed in the fabric whose lower plane is formed by three warp yarns (e.g., warp yarns 2-4) and one weft yarn (e.g., weft yarn 7).

Figure 2:
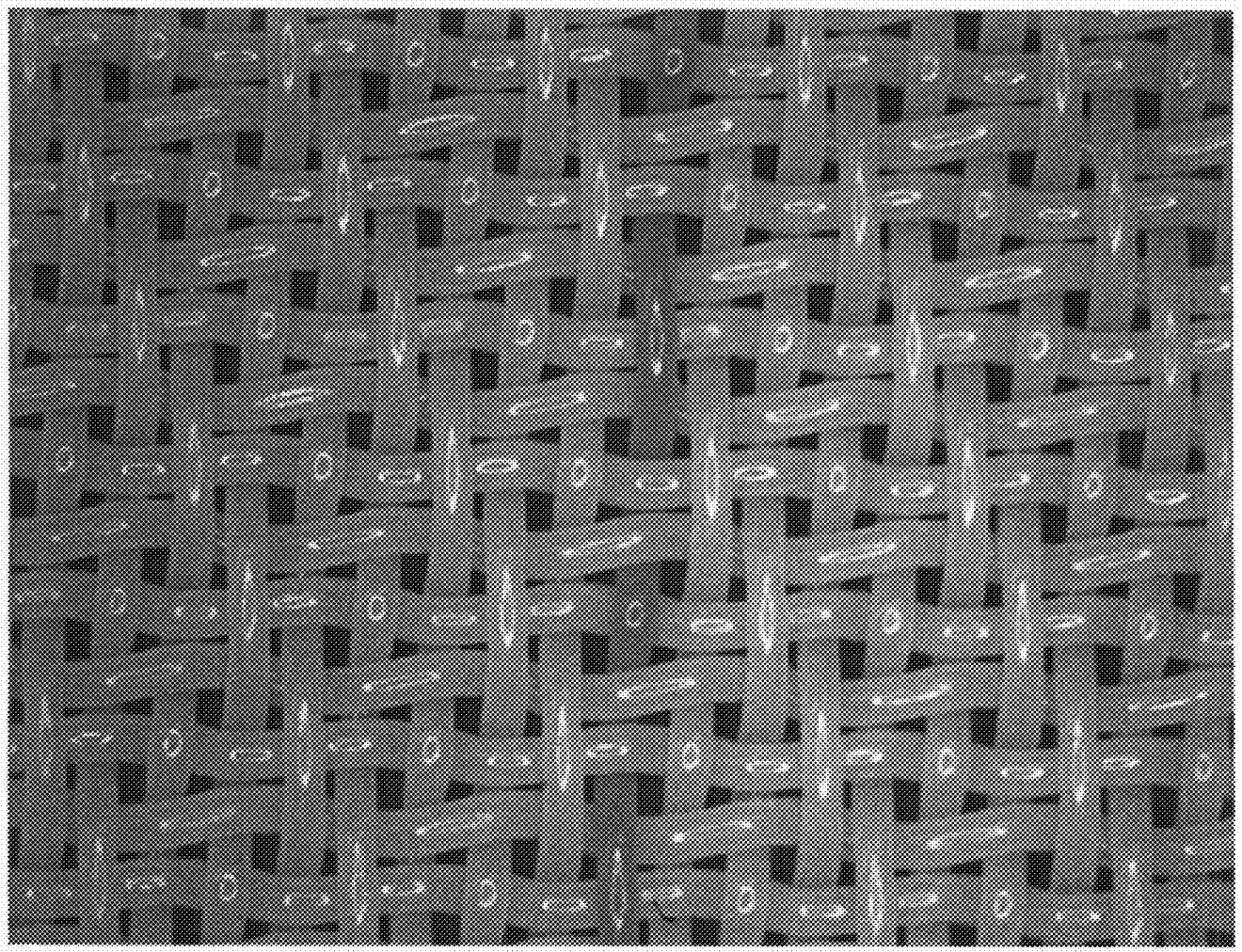
FIG. 2 shows a photograph of a papermaking side of a fabric woven with the pattern shown in FIGS. 1A-1C.

The fabric of FIG. 1A-1C show a weave pattern of the fabric that encompasses 4 warp or MD yarns (yarns 1-8 represented vertically in FIG. 1B are warp or MD yarns) and 8 weft or CD yarns (yarns 1-8 represented horizontally in FIG. 1B are weft or CD yarns). The fabric can be a 4 shed dsp. FIG. 1C depicts the paths of the warp yarns 1-8 as they weave with the weft yarns 1-8. While FIGS. 1A-1C only show two repeat units of the fabric, those of skill in the art will appreciate that in commercial applications the repeat unit shown in FIGS. 1A-1C would be repeated many times, in both the warp and weft directions, to form a large fabric suitable for use on a papermaking machine. FIG. 2 shows a photograph of a papermaking side of a fabric made with the pattern of FIGS. 1A-1C.

As seen in FIG. 1C, warp yarn 1 passes under weft yarns 1 and 2, then passes over weft yarn 3, then passes under weft yarns 4-5, and then passes over weft yarns 6-8. Warp yarn 1 thus passes over one weft yarn, e.g., weft yarn 3, and also over three adjacent weft yarns, e.g., weft yarns 6-8, which are spaced from the single weft yarn 3. Furthermore, one warp knuckle WPK is formed by warp yarn 1 per pattern repeat, i.e., by passing over weft yarns 6-8.

Warp yarn 2 passes over weft yarn 1, then passes under weft yarns 2-3, then passes over weft yarns 4-6, and then passes under weft yarns 7-8. Warp yarn 2 thus passes over one weft yarn, e.g., weft yarn 1, and also over three adjacent weft yarns, e.g., weft yarns 4-6, which are spaced from the single weft yarn 1. Furthermore, one warp knuckle WPK is formed by warp yarn 2 per pattern repeat, i.e., by passing over weft yarns 4-6.

Again, as seen in FIG. 1C, warp yarn 3 passes under weft yarn 1, then passes over weft yarns 2-4, then passes under weft yarns 5-6, then passes over weft yarn 7, and then passes under weft yarn 8. Warp yarn 3 thus passes over one weft yarn, e.g., weft yarn 7, and also over three adjacent weft yarns, e.g., weft yarns 2-4, which are spaced from the single weft yarn 7. Furthermore, one warp knuckle WPK is formed by warp yarn 3 per pattern repeat, i.e., by passing over weft yarns 2-4.

Warp yarn 4 passes over weft yarns 1-2, then passes under weft yarns 3-4, then passes over weft yarn 5, then passes under weft yarns 6-7, and then passes over weft yarn 8. Warp yarn 4 passes consecutively over weft yarns 8, 1 and 2 (weft yarns 1 and 2 of an adjacent repeat) and thus also forms a warp knuckle WPK. Warp yarn 4 also passes over one weft yarn, e.g., weft yarn 5, and also under two adjacent weft yarns on each side thereof, e.g., weft yarns 3-4 and 6-7.

Warp yarns 5-8 have the same respective weave pattern as warp yarns 1-4 and are thus not described herein in detail.

Figure 3A:
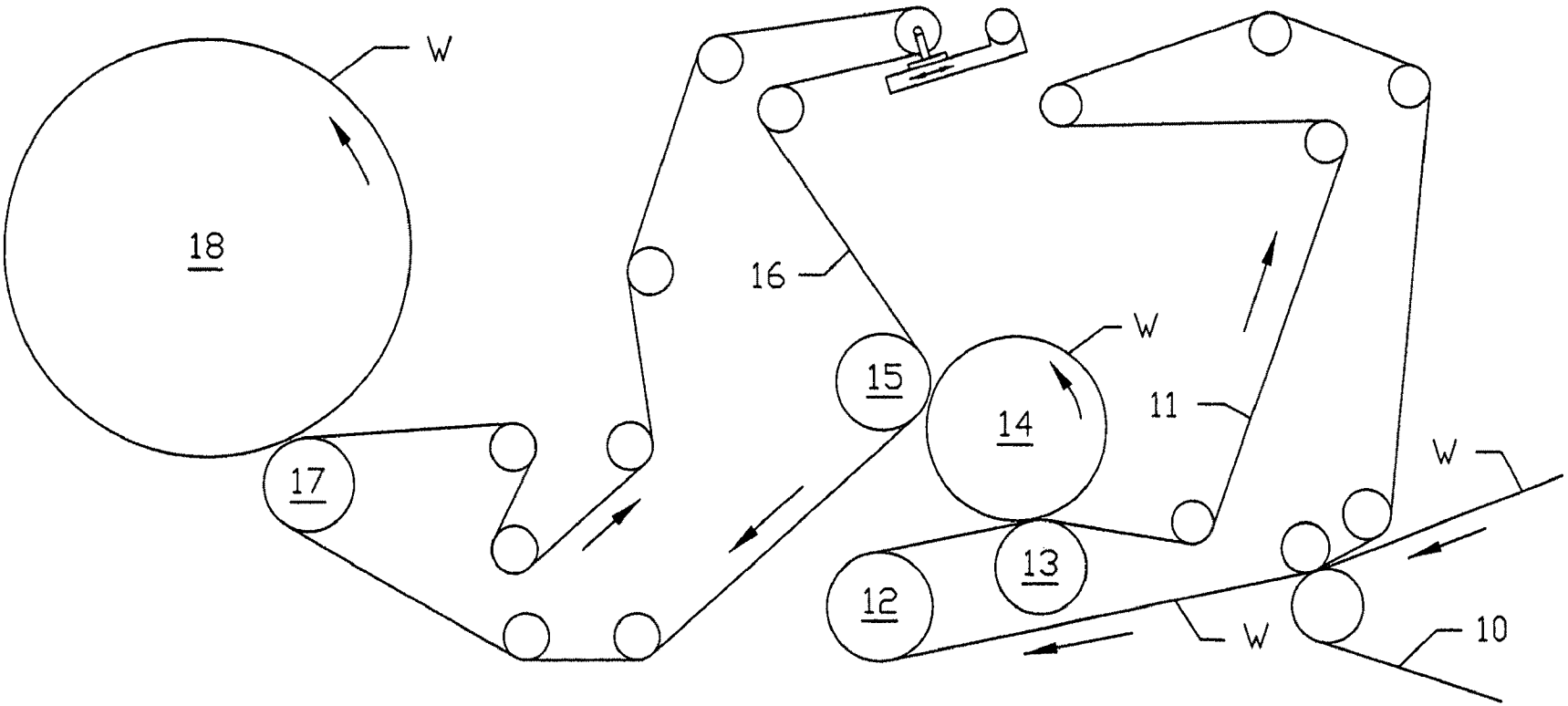
FIGS. 3A-3B show one non-limiting embodiment of an E-TAD machine utilizing the fabric of the invention.
Figure 3B:
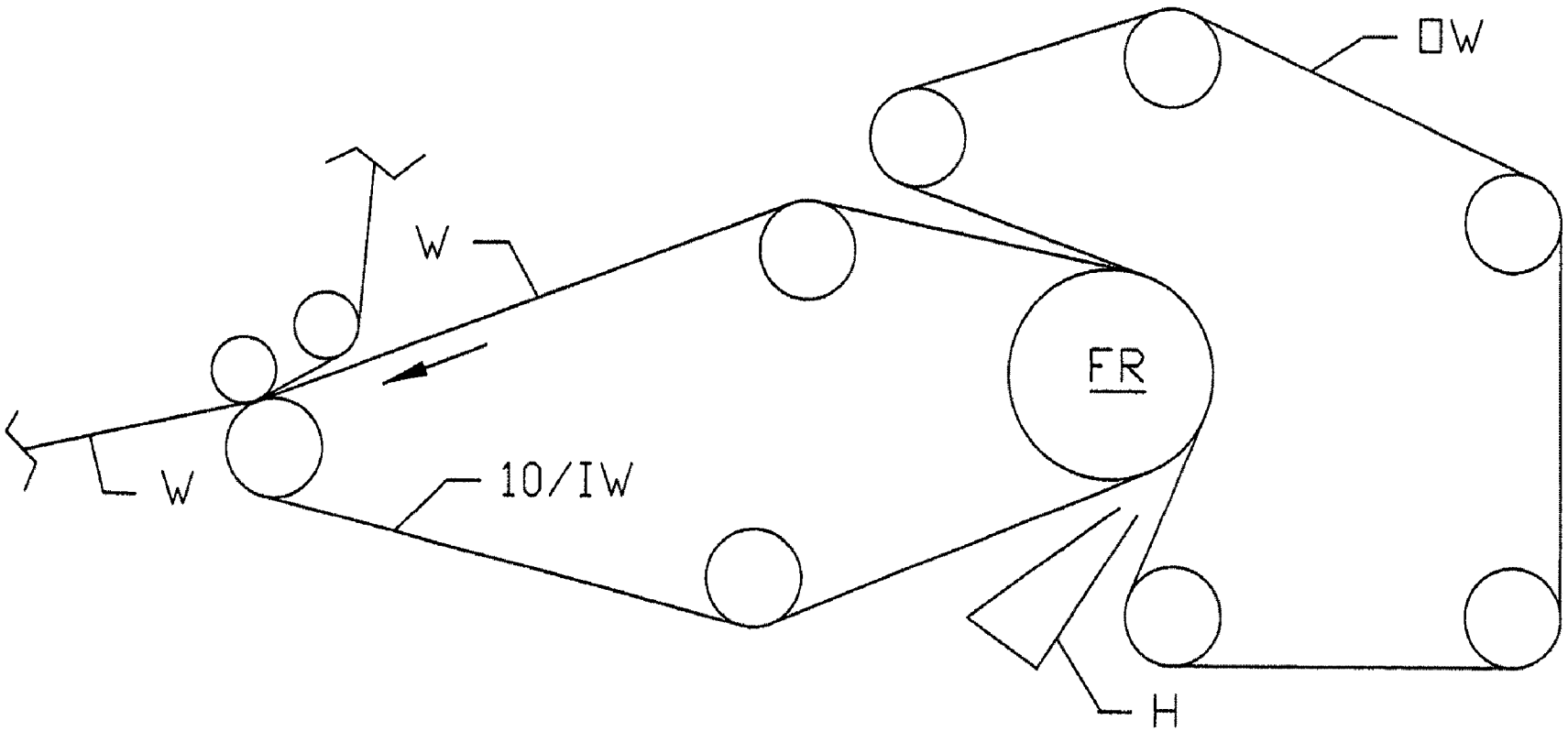

Referring now to FIGS. 3A and 3B, there is shown one non-limiting machine for forming or treating a fibrous web W. The machine includes a headbox H, and outer wire OW, and inner wire IW, and a forming roll FR. The inner wire IW can have the form of a fabric 10 which transfers the web W to a press felt 11. The press felt 11 carries the web around a suction roll 12 and then through a nip formed, e.g., by a shoe press roll 13 and a small diameter dryer or backing roll 14. The web W is transferred by the roll 14 to a structured fabric 16 at a nip formed by roll 14 and roll 15. The fabric 16 is preferably of the type shown in FIGS. 1 and 2. Furthermore, the fabric 16 is preferably moving at a lower speed than the roll 14. The web W can then be carried by the structured fabric 16 to a Yankee roll 18. The details of the fabrics and wires shown in FIGS. 3A and 3B can, by way of non-limiting example, be identical or similar to corresponding fabrics used in the embodiments shown in FIGS. 5-13 described below.

Figure 4:
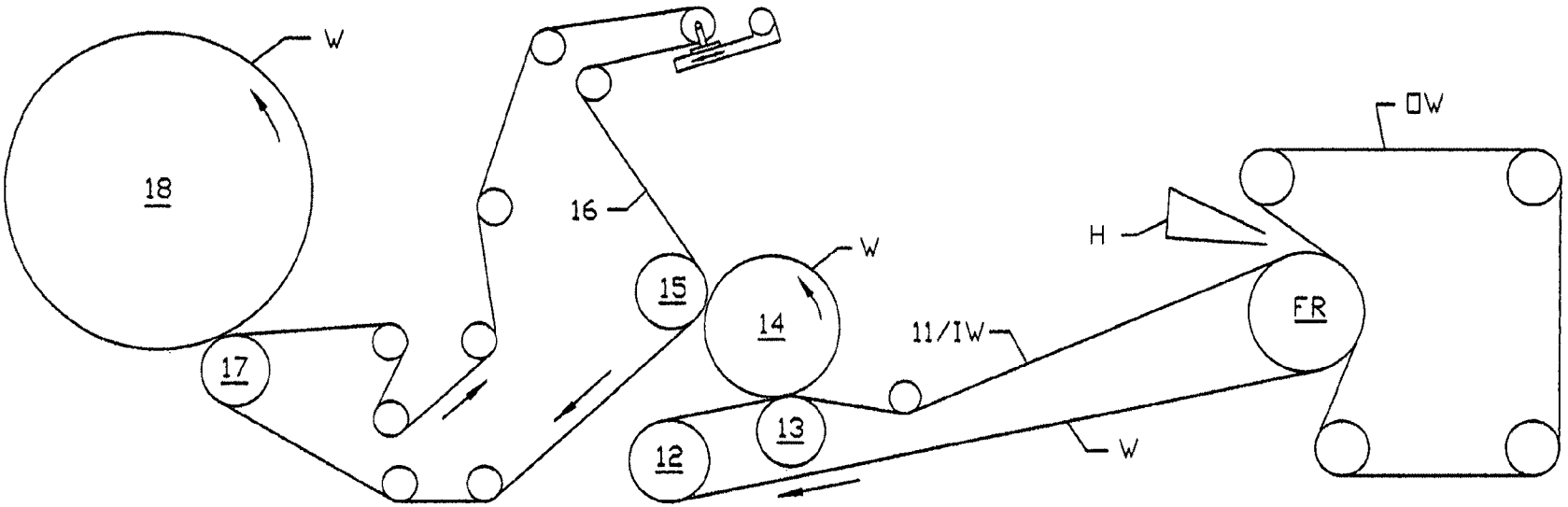
FIG. 4 shows another non-limiting embodiment of an E-TAD machine utilizing the fabric of the invention.

Referring now to FIG. 4, there is shown another non-limiting machine for forming or treating a fibrous web W. The machine includes a headbox H, and outer wire OW, and inner wire IW, and a forming roll FR. The inner wire IW can have the form of a fabric 11 which carries the web around a suction roll 12 and then through a nip formed by a shoe press roll 13 and a small diameter dryer or backing roll 14. The web W is transferred by the roll 14 to a structured fabric 16 at a nip formed by roll 14 and roll 15. The fabric 16 is preferably of the type shown in FIGS. 1 and 2. Furthermore, the fabric 16 is preferably moving at a lower speed than the roll 14. The web W can then be carried by the structured fabric 16 to a Yankee roll 18. The details of the fabrics and wires shown in FIG. 4 can, by way of non-limiting example, be identical or similar to corresponding fabrics used in the embodiments shown in FIGS. 5-13 described below.

Figure 5:
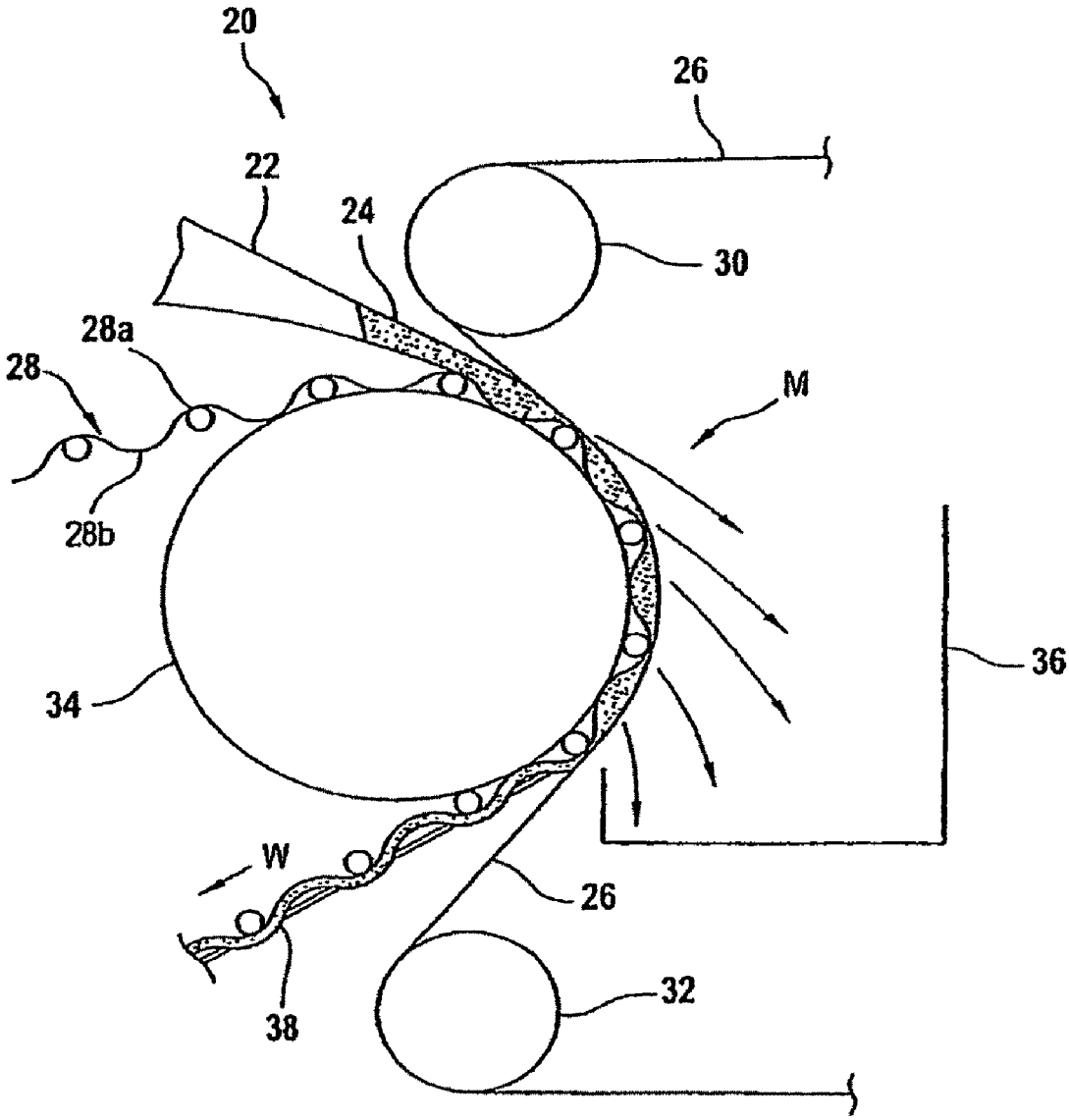
FIGS. 5-13 show non-limiting embodiments of an ATMOS system for making a web utilizing a structured fabric according to the invention.

Referring now to FIG. 5, there is a fibrous web machine 20 including a headbox 22 that discharges a fibrous slurry 24 between a outer forming fabric 26 and an inner structured fabric 28. The structured fabric 28 is preferably of the type shown and described with reference to FIGS. 1 and 2 described above. Rollers 30 and 32 direct fabric 26 in such a manner that tension is applied thereto, against slurry 24 and structured fabric 28. Structured fabric 28 is supported by forming roll 34 which rotates with a surface speed that matches the speed of structured fabric 28 and forming fabric 26. Structured fabric 28 has peaks 28*a* and valleys 28*b*, which give a corresponding structure to web 38 formed thereon. The valleys 28B preferably correspond to the pockets utilized in the fabric shown in FIGS. 1 and 2. Structured fabric 28 travels in direction W and as moisture M is driven from fibrous slurry 24, structured fibrous web 38 takes form. Moisture M that leaves slurry 24 travels through forming fabric 26 and is collected in save-all 36. Fibers in fibrous slurry 24 collect predominately in valleys 28*b* as web 38 takes form.

Structured fabric 28 includes warp and weft yarns interwoven on a textile loom. Structured fabric 28 may be woven flat or in an endless form. By way of non-limiting example, the final mesh count of structured fabric 28 can be between 95×120 and 26×20. For the manufacture of toilet tissue, the preferred mesh count is, by way of non-limiting example, 51×36 or higher and more preferably 58×44 or higher. For the manufacturer of paper towels, the preferred mesh count is 42×31 or lower, and more preferably 36×30 or lower. Structured fabric 28 may have a repeated pattern of 4 shed and above repeats, preferably 5 shed or greater repeats. The warp yarns of structured fabric 28 have diameters of between about 0.12 mm and about 0.70 mm, and weft yarns have diameters of between about 0.15 mm and about 0.60 mm. The pocket depth, which is the offset between peak 28*a* and valley 28*b*, can be between approximately 0.07 mm and 0.60 mm. The yarns utilized in structured fabric 28 may be of any cross-sectional shape, for example, round, oval or flat. The yarns of structured fabric 28 can also be made of thermoplastic or thermoset polymeric materials of any color. The surface of structured fabric 28 can be treated to provide a desired surface energy, thermal resistance, abrasion resistance and/or hydrolysis resistance. A printed design, such as a screen printed design, of polymeric material can be applied to structured fabric 28 to enhance its ability to impart an aesthetic pattern into web 38 or to enhance the quality of web 38. Such a design may also be in the form of an elastomeric cast structure similar to the Spectra® membrane described in another patent application. Structured fabric 28 can have a top surface plane contact area at peak 28*a* (defined by at least the warp knuckles) of about 10% or higher, preferably about 20% or higher, and more preferably about 30% depending upon the particular product being made. The contact area on structured web 28 at peak 28*a* can be increased by abrading the top surface of structured fabric 28 or an elastomeric cast structure can be formed thereon having a flat top surface. The top surface may also be hot calendered to increase the flatness.

According to one non-limiting embodiment, the forming roll 34 can preferably be a solid roll. Moisture travels through outer forming fabric 26 but not through structured fabric 28. This advantageously forms structured fibrous web 38 into a more bulky or absorbent web than the prior art.

The structured web 38 formed on the fabric 28 can thus have a sidewall thickness and pillow thickness that exceed comparable dimensions of a prior art web. This advantageously results from the forming of structural web 38 on structured fabric 28 at low consistency and the removal of moisture is an opposite direction from the prior art. This results in a thicker pillow dimension. Even after fiber web 38 goes through a drying press operation, this dimension is substantially greater and the prior art. Advantageously, the fiber web resulting from the present invention has a higher basis weight in the pillow areas as compared to prior art. Also, the fiber to fiber bonds are not broken as they can be in impression operations, which expand the web into the valleys.

The process of forming the web will now be explained. First, a fibrous slurry 24 is formed into a web 38 with a structure inherent in the shape of structured fabric 28. Forming fabric 26 is porous and allows moisture to escape during forming. Further, water is removed as shown in FIG. 5, through dewatering fabric 26. The removal of moisture through fabric 28 does not cause a compression of pillow areas in the web 38, since pillow areas reside in the structure of structured fabric 28. Normal contact area of the structured fabric 28, as in this present invention, or as on a TAD machine, is typically much lower than that of a conventional machine, and can be in the range of about 15% to 35% depending on the particular pattern of the product being made.

As noted above, water is drawn through dewatering fabric 26 as shown in FIG. 5 preserving pillow areas. Pillow areas are essentially unpressed zones formed on structured fabric 28 which are preserved even when pressed against a Yankee roll 52 (see e.g., FIG. 6). The pressed zones of the web 38 are formed by the warp and weft knuckles WPK and WFK (see FIG. 1B) and is the area through which most of the pressure applied in forming is transferred to the web 38. The pillow areas of the web 38 are formed by the pockets and generally have a higher basis weight than that of the prior art structures.

The increased mass ratio of the present invention, in particularly, the higher basis weight in the pillow areas, carries more water than the compressed areas, resulting in at least two positive aspects of the present invention over the prior art. First, it allows for a good transfer of the web to the Yankee 52 (see e.g., FIG. 6), since the web has a relatively lower basis weight in the portion that comes in contact with the Yankee 52, at a lower overall sheet solid content than had been previously attainable, because of the lower mass of fibers that comes in contact with the Yankee dryer 52. The lower basis weight means that less water is carried to the contact points with the Yankee dryer 52. The compressed areas are dryer than the pillow areas, thereby allowing an overall transfer of the web to another surface, such as a Yankee dryer 52, with a lower overall web solids content. Secondly, the construct allows for the use of higher temperatures in the Yankee hood 54 without scorching or burning of the pillow areas, which occurs in the prior art pillow areas. The Yankee hood 54 temperatures can thus be greater than about 350° C. and preferably greater than about 450° C., and even more preferably are greater than about 550° C. As a result, the present invention can operate at lower average pre-Yankee press solids than the prior art, making more full use of the capacity of the Yankee Hood drying system. The present invention can allows the solids content of web 38 prior to the Yankee dryer 52 to run at less than about 40%, and/or less than about 35%, and/or even as low as about 25%.

Because the web 38 is formed with the structured fabric 28 of the invention, the pockets of the fabric 28 can be fully filled with fibers. As such, at the Yankee 52, the web 38 can have a much higher contact area, e.g., up to approx. 100%, as compared to the prior art. This is because the web 38 on the side contacting the Yankee 52 is almost flat. At the same time, the pillow areas of the web 38 can be essentially unpressed, because they are protected by the valleys of the structured fabric 28. Good results in drying efficiency can thus be obtained with pressing of only 25% of the web.

Figure 6:
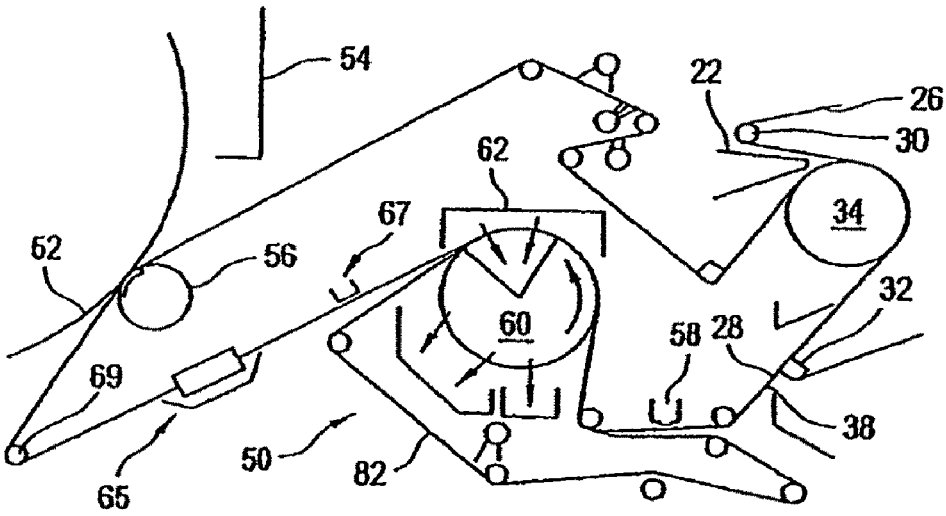

With reference to FIGS. 5 and 6, there is shown an embodiment of the process where a structured fiber web 38 is formed. Structured fabric 28 carries a three dimensional structured web 38 to an advanced dewatering system 50, past suction box 67 and then to a Yankee roll 52 where the web is transferred to the Yankee roll 52 and hood section 54 for additional drying and creping before winding up on a reel (not shown). A shoe press 56 is placed adjacent to structured fabric 28, holding it in a position proximate the Yankee roll 52. Structured web 38 comes into contact with Yankee roll 52 and transfers to a surface thereof, for further drying and subsequent creping.

A vacuum box 58 is placed adjacent to structured fabric 28 to achieve a solids level of approximately 15-25% on a nominal 20 gsm web running at between about −0.2 to about −0.8 bar vacuum with a preferred operating level of about −0.4 to about −0.6 bar. Web 38, which is carried by structured fabric 28, contacts dewatering fabric 82 and proceeds toward vacuum roll 60. Vacuum roll 60 operates at a vacuum level of between about −0.2 and about −0.8 bar with a preferred operating level of at least about −0.4 bar. Hot air hood 62 is optionally fit over vacuum roll 60 to improve dewatering. For example, the arrangement can utilize a commercial Yankee drying cylinder with about a 44 mm steel thickness and a conventional hood with an air blowing speed of about 145 m/s and production speeds of about 1400 m/min or more for towel paper, and about 1700 m/min or more for toilet paper are used.

Optionally, a steam box can be installed instead of the hood 62 for supplying steam to the web 38. Preferably, the steam box has a sectionalized design to influence the moisture redryness cross profile of the web 38. The length of the vacuum zone inside the vacuum roll 60 can be from about 200 mm to about 2,500 mm, with a preferable length of about 300 mm to about 1,200 mm and an even more preferable length of between about 400 mm to about 800 mm. The solids level of web 38 leaving suction roll 60 can be between about 25% to about 55% depending on installed options. A vacuum box 67 and hot air supply 65 can be used to increase web 38 solids after vacuum roll 60 and prior to Yankee roll 52. Wire turning roll 69 can also be a suction roll with a hot air supply hood. Roll 56 includes a shoe press with a shoe width of about 80 mm or higher, preferably about 120 mm or higher, with a maximum peak pressure of less than about 2.5 MPa. To create an even longer nip to facilitate the transfer of web 38 to Yankee 52, web 38 carried on structured fabric 28 can be brought into contact with the surface of Yankee roll 52 prior to the press nip associated with shoe press 56. Further, the contact can be maintained after structured fabric 28 travels beyond press 56.

Dewatering fabric 82 may have a permeable woven base fabric connected to a batt layer. The base fabric includes machine direction yarns and cross-directional yarns. The machine direction yarn can be a 3 ply multifilament twisted yarn. The cross-direction yarn can be a monofilament yarn. The machine direction yarn can also be a monofilament yarn and the construction can be of a typical multilayer design. In either case, the base fabric should have a fine batt fiber having a weight of less than or equal to about 700 gsm, preferably less than or equal to about 150 gsm and more preferably less than or equal to about 135 gsm. The batt fiber encapsulates the base structure giving it sufficient stability. The needling process can be such that straight through channels are created. The sheet contacting surface is heated to improve its surface smoothness "s". The cross-sectional area of the machine direction yarns can be larger than the cross-sectional area of the cross-direction yarns. The machine direction yarn can be a multifilament yarn that may include thousands of fibers. The base fabric can be connected to a batt layer by a needling process that results in straight through drainage channels.

In another embodiment of dewatering fabric 82, there is included a fabric layer, at least two batt layers, an anti-rewetting layer, and an adhesive. The base fabric can be substantially similar to the previous description. At least one of the batt layers includes a low melt bi-compound fiber to supplement fiber to fiber bonding upon heating. On one side of the base fabric, there is attached an anti-rewetting layer, which may be attached to the base fabric by an adhesive, a melting process or needling wherein the material contained in the anti-rewet layer is connected to the base fabric layer and a batt layer. The anti-rewetting layer can be made of an elastomeric material thereby forming elastomeric membrane, which has openings there through. The batt layers can be needled to thereby hold dewatering fabric 82 together. This advantageously leaves the batt layers with many needled holes there through. The anti-rewetting layer is porous having water channels or straight through pores there through.

In yet another embodiment of dewatering fabric 82, there is a construction substantially similar to that previously discussed with the addition of a hydrophobic layer to at least one side of de-watering fabric 82. The hydrophobic layer does not absorb water, but does direct water through pores therein.

In yet another embodiment of dewatering fabric 82, the base fabric has attached thereto a lattice grid made of a polymer, such as polyurethane, that is put on top of the base fabric. The grid may be put on to the base fabric by utilizing various known procedures, such as, for example, an extrusion technique or a screen-printing technique. The lattice grid may be put on the base fabric with an angular orientation relative to the machine direction yarns and the cross direction yarns. Although this orientation is such that no part of the lattice is aligned with the machine direction yarns, other orientations can also be utilized. The lattice can have a uniform grid pattern, which can be discontinuous in part. Further, the material between the interconnections of the lattice structure may take a circuitous path rather than being substantially straight. The lattice grid is made of a synthetic, such as a polymer or specifically a polyurethane, which attaches itself to the base fabric by its natural adhesion properties.

In yet another embodiment of dewatering fabric 82, there is included a permeable base fabric having machine direction yarns and cross-direction yarns that are adhered to a grid. The grid is made of a composite material the may be the same as that discussed relative to a previous embodiment of dewatering fabric 82. The grid includes machine direction yarns with a composite material formed there around. The grid is a composite structure formed of composite material and machine direction yarns. The machine direction yarns may be pre-coated with a composite before being placed in rows that are substantially parallel in a mold that is used to reheat the composite material causing it to re-flow into a pattern. Additional composite material may be put into the mold as well. The grid structure, also known as a composite layer, is then connected to the base fabric by one of many techniques including laminating the grid to the permeable fabric, melting the composite coated yarn as it is held in position against the permeable fabric or by re-melting the grid onto the base fabric. Additionally, an adhesive may be utilized to attach the grid to permeable fabric. The batt fiber may include two layers, an upper and a lower layer. The batt fiber is needled into the base fabric and the composite layer, thereby forming a dewatering fabric 82 having at least one outer batt layer surface. Batt material is porous by its nature, additionally the needling process not only connects the layers together, but it also creates numerous small porous cavities extending into or completely through the structure of dewatering fabric 82.

Dewatering fabric 82 can have an air permeability of from about 5 to about 100 cubic feet/minute, preferably about 19 cubic feet/minute or higher, and more preferably about 35 cubic feet/minute or higher. Mean pore diameters in dewatering fabric 82 can be from about 5 to about 75 microns, preferably about 25 microns or higher, and more preferably about 35 microns or higher. The hydrophobic layers can be made from a synthetic polymeric material, a wool or a polyamide, for example, nylon 6. The anti-rewet layer and the composite layer may be made of a thin elastomeric permeable membrane made from a synthetic polymeric material or a polyamide that is laminated to the base fabric. The batt fiber layers can be made from fibers ranging from about 0.5 d-tex to about 22 d-tex and may contain a low melt bi-compound fiber to supplement fiber to fiber bonding in each of the layers upon heating. The bonding may result from the use of a low temperature meltable fiber, particles and/or resin. The dewatering fabric can be less than about 2.0 millimeters, or less than about 1.50 millimeters, or less than about 1.25 millimeters, or less than about 1.0 millimeter thick.

Preferred embodiments of the dewatering fabric 82 are also described in the PCT/EP2004/053688 and PCT/EP2005/050198 which are herein expressly incorporated by reference in their entireties.

Figure 7:
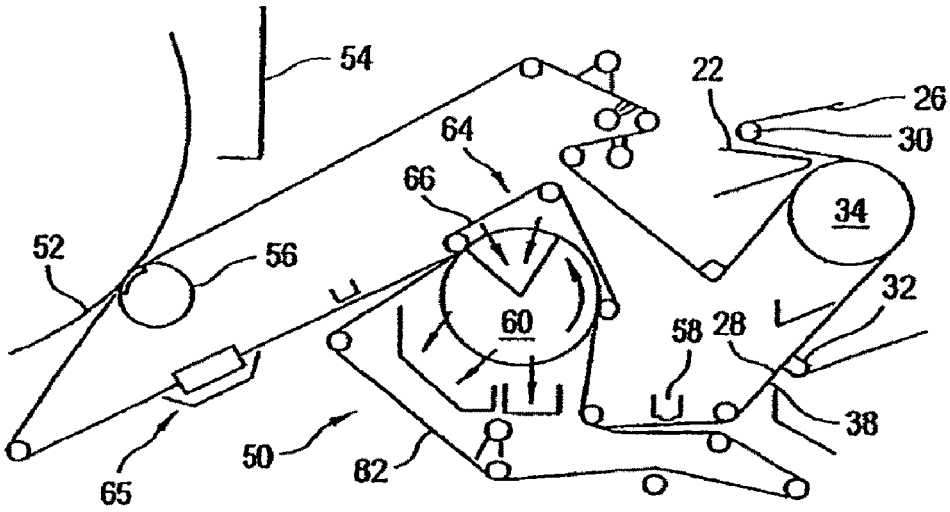

Referring to FIG. 7, there is shown yet another embodiment of the present invention, which is substantially similar to the invention illustrated in FIG. 6, except that instead of hot air hood 62, there is a belt press 64. Belt press 64 includes a permeable belt 66 capable of applying pressure to the non-sheet contacting side of structured fabric 28 (i.e., of the type of the present invention) that carries web 38 around suction roll 60. Fabric 66 of belt press 64 is preferably an extended nip press belt or a link fabric, which can run at about 60 KN/m fabric tension with a pressing length that is longer than the suction zone of roll 60. Preferred embodiments of the fabric 66 and the required operation conditions are also described in PCT/EP2004/053688 and PCT/EP2005/050198 which are herein incorporated by reference.

While pressure is applied to structured fabric 28, the high fiber density pillow areas in web 38 are protected from that pressure as they are contained within the body of structured fabric 28, as they are in the Yankee nip. Belt 66 is a specially designed Extended Nip Press Belt 66, made of, for example reinforced polyurethane and/or a spiral link fabric. Belt 66 is permeable thereby allowing air to flow there through to enhance the moisture removing capability of belt press 64. Moisture is drawn from web 38 through dewatering fabric 82 and into vacuum roll 60. Belt 66 provides a low level of pressing in the range of about 50 to about 300 KPa and preferably greater than about 100 KPa. This allows a suction roll with a 1.2 meter diameter to have a fabric tension of greater than about 30 KN/m and preferably greater than about 60 KN/m. The pressing length of permeable belt 66 against fabric 28, which is indirectly supported by vacuum roll 60, is at least as long as a suction zone in roll 60. The contact portion of belt 66 can also be shorter than the suction zone.

Permeable belt 66 can have a pattern of holes there through, which may, for example, be drilled, laser cut, etched formed or woven therein. Permeable belt 66 may be monoplanar without grooves. In one embodiment, the surface of belt 66 has grooves and is placed in contact with fabric 28 along a portion of the travel of permeable belt 66 in belt press 64. Each groove can connect with a set of the holes to allow the passage and distribution of air in belt 66. Air is distributed along the grooves, which constitutes an open area adjacent to contact areas, where the surface of belt 66 applies pressure against web 38. Air enters permeable belt 66 through the holes and then migrates along the grooves, passing through fabric 28, web 38 and fabric 82. The diameter of the holes may be larger than the width of the grooves. The grooves may have a cross-section contour that is generally rectangular, triangular, trapezoidal, semi-circular or semi-elliptical. The combination of permeable belt 66, associated with vacuum roll 60, is a combination that has been shown to increase sheet solids by at least about 15%.

An example of another structure of belt 66 is that of a thin spiral link fabric, which can be a reinforcing structure within belt 66 or the spiral link fabric will itself serve as belt 66. Within fabric 28 there is a three dimensional structure that is reflected in web 38. Web 38 has thicker pillow areas, which are protected during pressing as they are within the body of structured fabric 28. As such the pressing imparted by belt press assembly 64 upon web 38 does not negatively impact web quality, while it increases the dewatering rate of vacuum roll 60.

Figure 8:
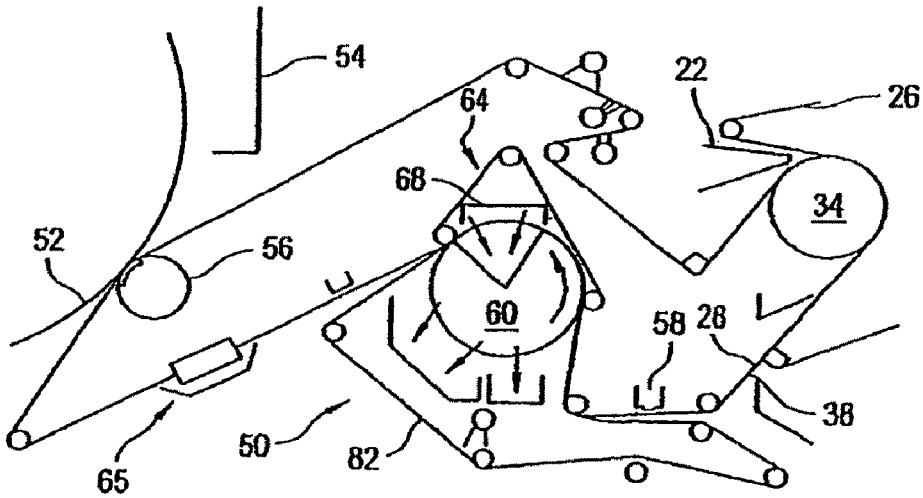

Referring to FIG. 8, which is substantially similar to the embodiment shown in FIG. 7, except that it includes a hot air hood 68 placed inside of belt press 64 to enhance the dewatering capability of belt press 64 in conjunction with vacuum roll 60.

Figure 9:
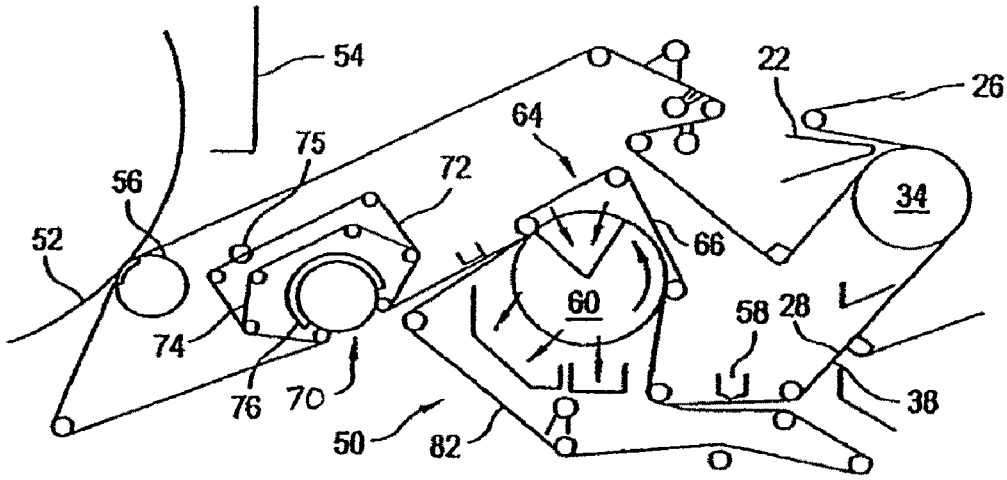

Referring to FIG. 9, there is shown yet another embodiment of the present invention, which is substantially similar to the embodiment shown in FIG. 7, but includes a boost dryer 70, which encounters structured fabric 28. Web 38 is subjected to a hot surface of boost driver 70, structure web 38 rides around boost driver 70 with another woven fabric 72 riding on top of structured fabric 28. On top of woven fabric 72 is a thermally conductive fabric 74, which is in contact with both woven fabric 72 and a cooling jacket 76 that applies cooling and pressure to all fabrics and web 38. Here, again, the higher fiber density pillow areas in web 38 are protected from the pressure as they are contained within the body of structured fabric 28. As such, the pressing process does not negatively impact web quality. The drying rate of boost dryer 70 can be above about 400 kg/hrm$^2$ and is preferably above about 500 kg/hrm$^2$. The concept of boost dryer 70 is to provide sufficient pressure to hold web 38 against the hot surface of the dryer thus preventing blistering. Steam that is formed at the knuckle points passes through fabric 28 and is condensed on fabric 72. Fabric 72 is cooled by fabric 74 that is in contact with the cooling jacket, which reduces its temperature to well below that of the steam. Thus the steam is condensed to avoid a pressure build up to thereby avoid blistering of web 38. The condensed water is captured in woven fabric 72, which is dewatered by dewatering device 75. It has been shown that depending on the size of boost dryer 70, the need for vacuum roll 60 can be eliminated. Further, depending upon the size of boost dryer 70, web 38 may be creped on the surface of boost dryer 70, thereby eliminating the need for Yankee dryer 52.

Figure 10:
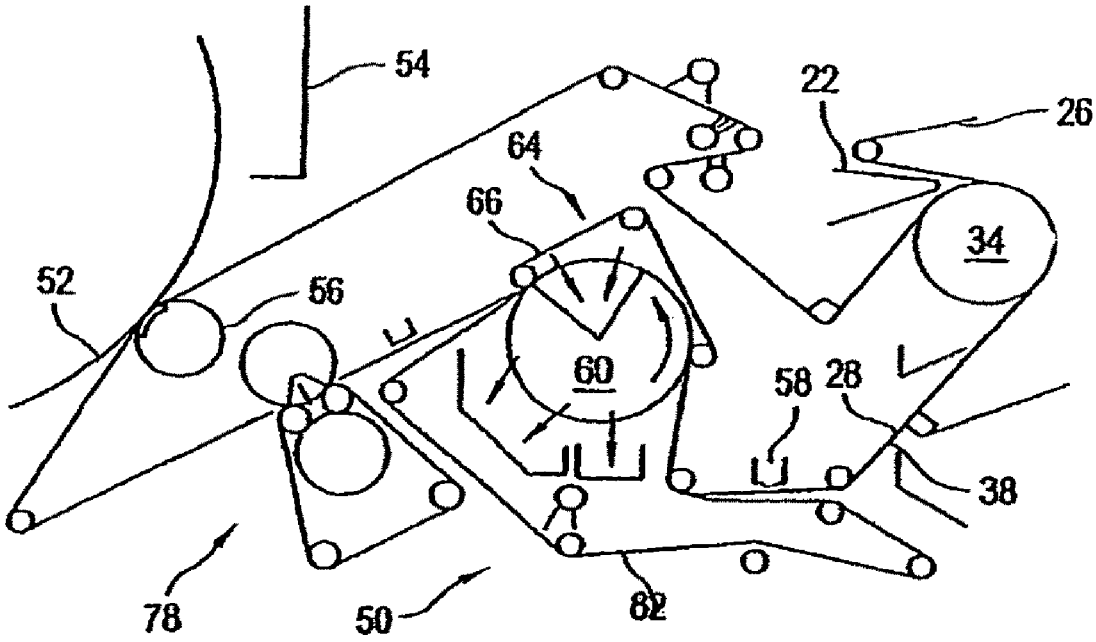

Referring to FIG. 10, there is shown yet another embodiment of the present invention substantially similar to the invention disclosed in FIG. 7 but with the addition of an air press 78, which is a four roll cluster press that is used with high temperature air and is referred to as an HPTAD for additional web drying prior to the transfer of web 38 to Yankee 52. Four roll cluster press 78 includes a main roll and a vented roll and two cap rolls. The purpose of this cluster press is to provide a sealed chamber that is capable of being pressurized. The pressure chamber contains high temperature air, for example, about 150° C. or higher and is at a significantly higher pressure than conventional TAD technology, for example, greater than about 1.5 psi resulting in a much higher drying rate than a conventional TAD. The high pressure hot air passes through an optional air dispersion fabric, through web 38 and fabric 28 into a vent roll. The air dispersion fabric may prevent web 38 from following one of the four cap rolls. The air dispersion fabric is very open, having a permeability that equals or exceeds that of fabric 28. The drying rate of the HPTAD depends on the solids content of web 38 as it enters the HPTAD. The preferred drying rate is at least 500 kg/hr/m$^2$, which is a rate of at least twice that of conventional TAD machines.

Advantages of the HPTAD process are in the areas of improved sheet dewatering without a significant loss in sheet quality, compactness in size and energy efficiency. Additionally, it enables higher pre-Yankee solids, which increase the speed potential of the invention. Further, the compact size of the HPTAD allows for easy retrofit to an existing machine. The compact size of the HPTAD and the fact that it is a closed system means that it can be easily insulated and optimized as a unit to increase energy efficiency.

Figure 11:
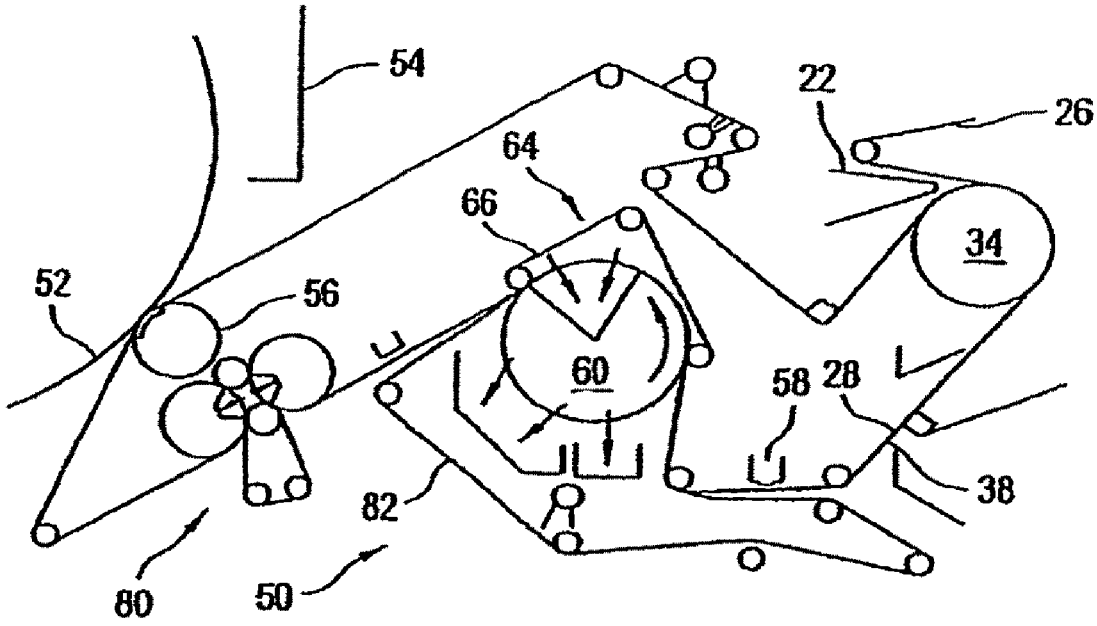

Referring to FIG. 11, there is shown another embodiment of the present invention. This is significantly similar to FIGS. 7 and 10 except for the addition of a two-pass HPTAD 80. In this case, two vented rolls are used to double the dwell time of structured web 38 relative to the design shown in FIG. 10. An optional coarse mesh fabric may used as in the previous embodiment. Hot pressurized air passes through web 38 carried on fabric 28 and onto the two vent rolls. It has been shown that depending on the configuration and size of the HPTAD, that more than one HPTAD can be placed in series, which can eliminate the need for roll 60.

Figure 12:
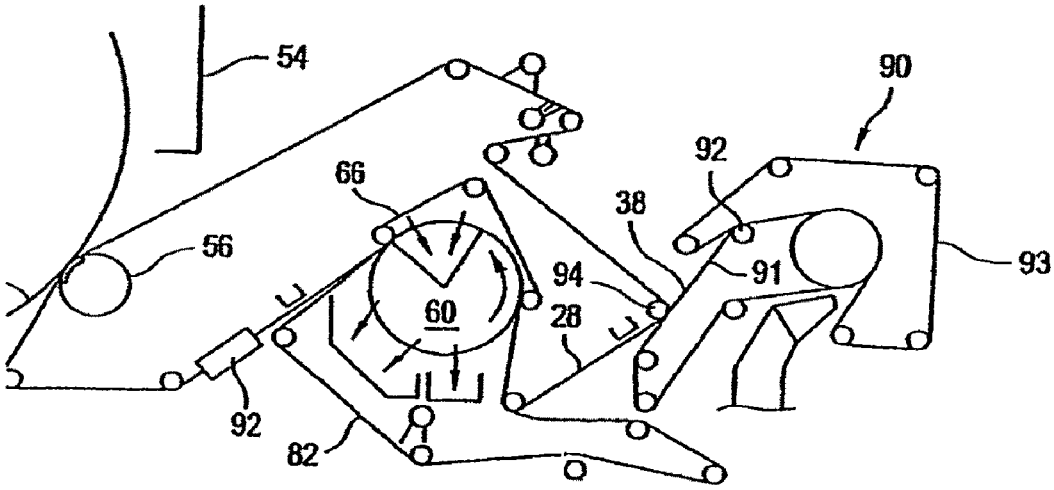

Referring to FIG. 12, a conventional Twin Wire Former 90 may be used to replace the Crescent Former shown in previous examples. The forming roll can be either a solid or open roll. If an open roll is used, care must be taken to prevent significant dewatering through the structured fabric to avoid losing basis weight in the pillow areas. The outer forming fabric 93 can be either a standard forming fabric or one such as that disclosed in U.S. Pat. No. 6,237,644. The inner forming fabric 91 is preferably a structured fabric 91 that is much coarser than the outer forming fabric. A vacuum box 92 may be needed to ensure that the web stays with structured wire 91 and does not go with outer wire 90. Web 38 is transferred to structured fabric 28 using a vacuum device. The transfer can be a stationary vacuum shoe or a vacuum assisted rotating pick-up roll 94. The second structured fabric 28 is at least the same coarseness and preferably courser than first structured fabric 91 and preferably of the type shown in FIGS. 1 and 2, as was the case in previous embodiments. The process from this point is the same as one or more of the previously discussed processes. The transfer of the web from the first structured fabric 91 to the second structured fabric 28 is not perfect, as such some pillows will lose some basis weight during the expansion process, thereby losing some of the benefit of the present invention. However, this process option allows for utilizing a differential speed transfer, i.e., belts 91 and 28 can run at different speeds, which has been shown to improve some sheet properties. Any of the arrangements for removing water discussed above as may be used with the Twin Wire Former arrangement and a conventional TAD.

The fiber distribution of web 38 according to the invention can thus be opposite that of the prior art, which is a result of removing moisture through the forming fabric and not through the structured fabric. The low density pillow areas are of relatively higher basis weight than the surrounding compressed zones, which is opposite of conventional TAD paper. This allows a high percentage of the fibers to remain uncompressed during the process. The sheet absorbency capacity as measured by the basket method, for a nominal 20 gsm web can be equal to or greater than about 12 grams water per gram of fiber and can exceeds about 15 grams of water per gram fiber. The sheet bulk can be equal to or greater than about 10 cm$^3$/gm and preferably greater than about 13 cm$^3$/gm. The sheet bulk of toilet tissue is expected to be equal to or greater than about 13 $cm^3$/gm before calendering.

Referring again to FIG. 5, the forming of the web 38 will now be described in detail. The papermaking machine 20 includes a headbox 22 that discharges a fibrous slurry 24 between forming fabric 26 and a woven structured fabric 28. Rollers 30 and 32 direct fabric 26 in such a manner that tension is applied thereto, against slurry 24 and woven structured fabric 28. Woven structured fabric 28 is supported by forming roll 34, which rotates with a surface speed that matches the speed of woven structured fabric 28 and forming fabric 26. Structured fabric 28 has peaks 28*a* and valleys 28*b*, which give a corresponding structure to web 38 formed thereon. Structured fabric 28 travels in direction W, and as moisture M is driven from fibrous slurry 24, a structured fibrous web 38 takes form. Moisture M leaves slurry 24 travels through forming fabric 26 and is collected in save-all 36. Fibers in fibrous slurry 24 collect predominately in valleys 28*b* as web 38 takes form. As slurry 24 comes from headbox 22 it has a very low consistency of approximately 0.1 to approximately 0.5%. The consistency of web 38 increases to approximately 7% at the end of the forming section outlet. Structured fabric 28 carries web 38 from where it is first placed there by headbox 22 all of the way to a Yankee dryer to thereby provide a well defined paper structure for maximum bulk and absorbency capacity. Web 38 has exceptional caliper, bulk and absorbency, about 30% higher than with a conventional TAD fabric used for producing paper towels. Excellent transfer of web 38 to the Yankee dryer takes place with the ATMOS™ system working at about 33% to about 37% dryness, which is a higher moisture content than the TAD of 60% to 75%. There is no dryness loss running in the ATMOS™ configuration, since structured fabric 28 has pocket depth (valleys) there is no loss of intimacy between a dewatering fabric, web 38, structured fabric 28 and the belt, which is key to reaching the desired dryness with the ATMOS™ system.

Figure 13:
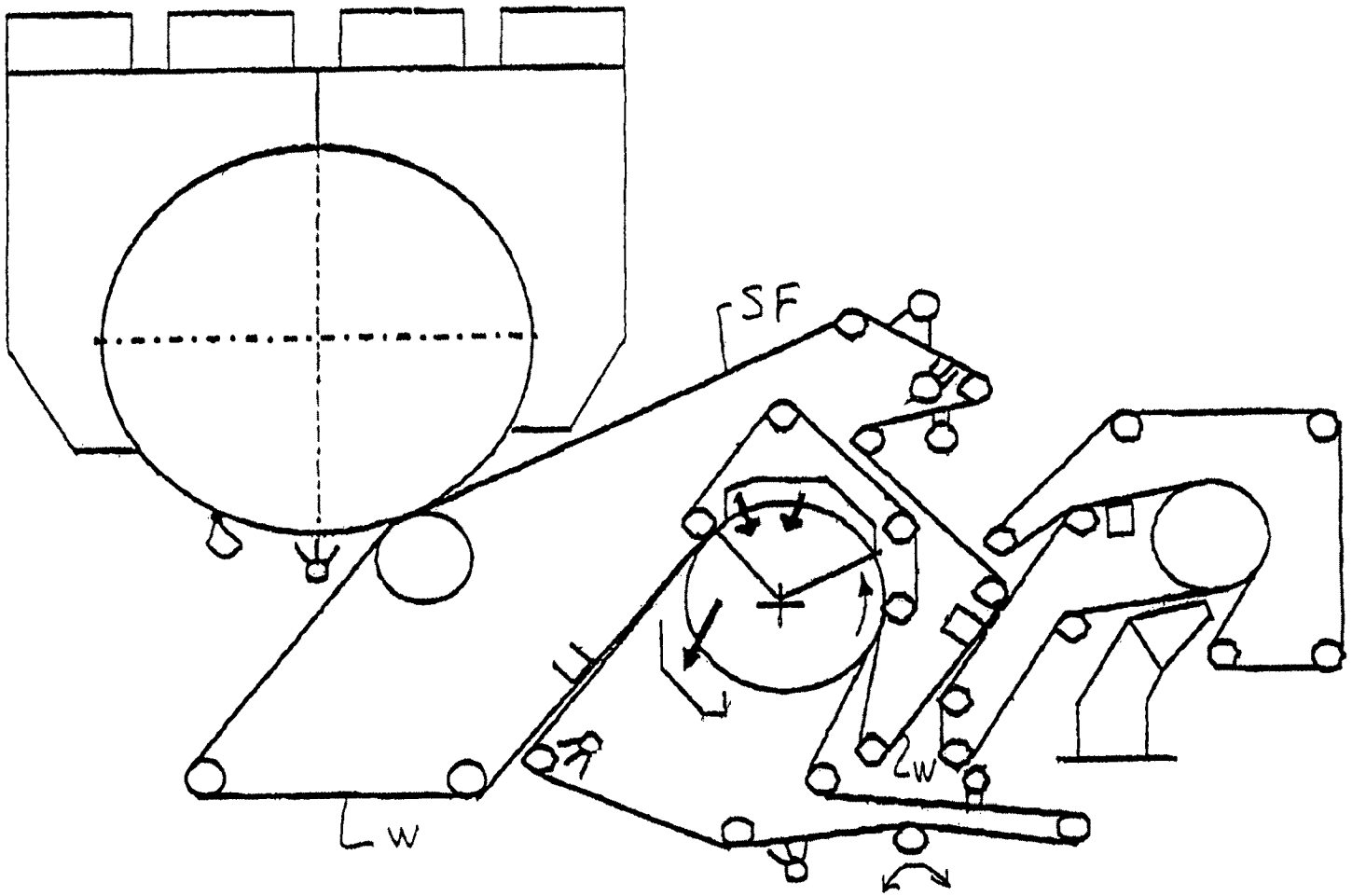
Figure 14A:
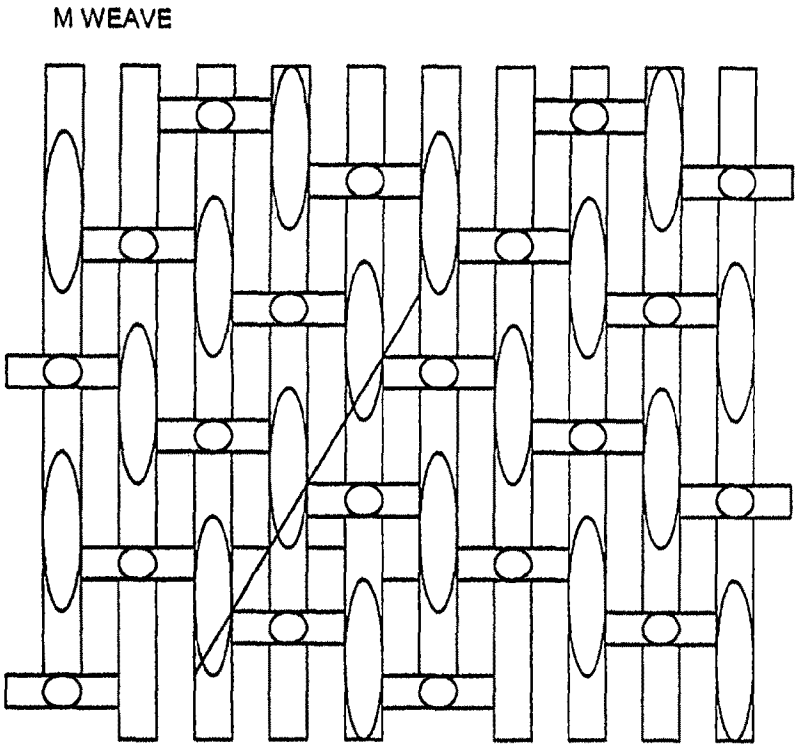
FIGS. 14A-14C show a prior art fabric having an M weave and illustrates the pattern repeat thereof.
Figure 14B:
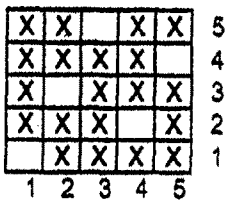
PRIOR ART Fig. 14B
Figure 14C:
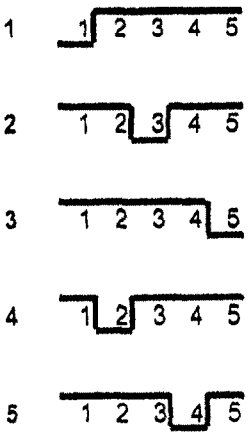
PRIOR ART Fig. 14C
Figure 15A:
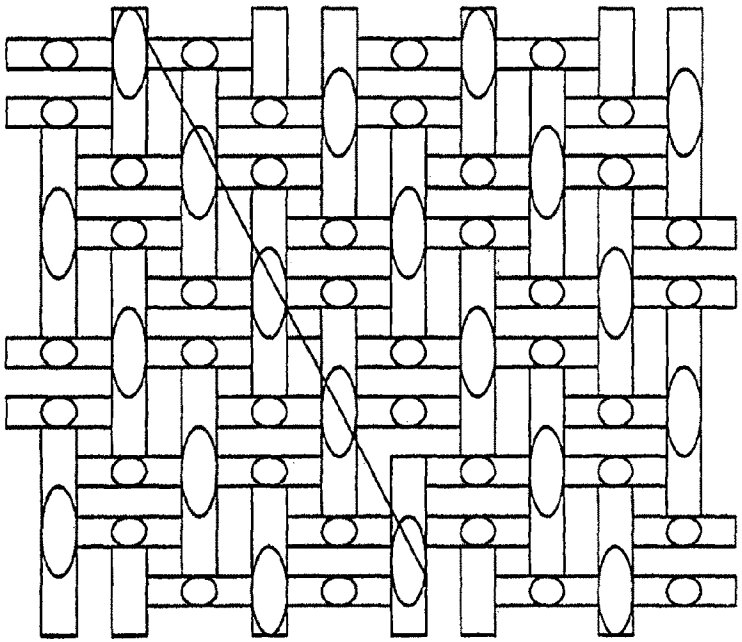
FIGS. 15A-15C show a prior art fabric having an G weave and illustrates the pattern repeat thereof.
Figure 15B:
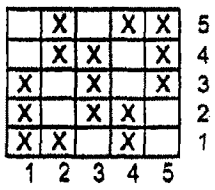
PRIOR ART Fig. 15B
Figure 15C:
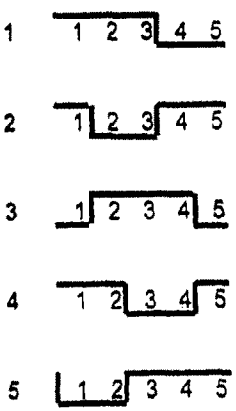
PRIOR ART Fig. 15C
Figure 16A:
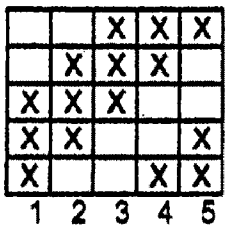
FIGS. 16A-16B show a prior art fabric having a straight twill G weave and illustrates the pattern repeat thereof.
Figure 16B:
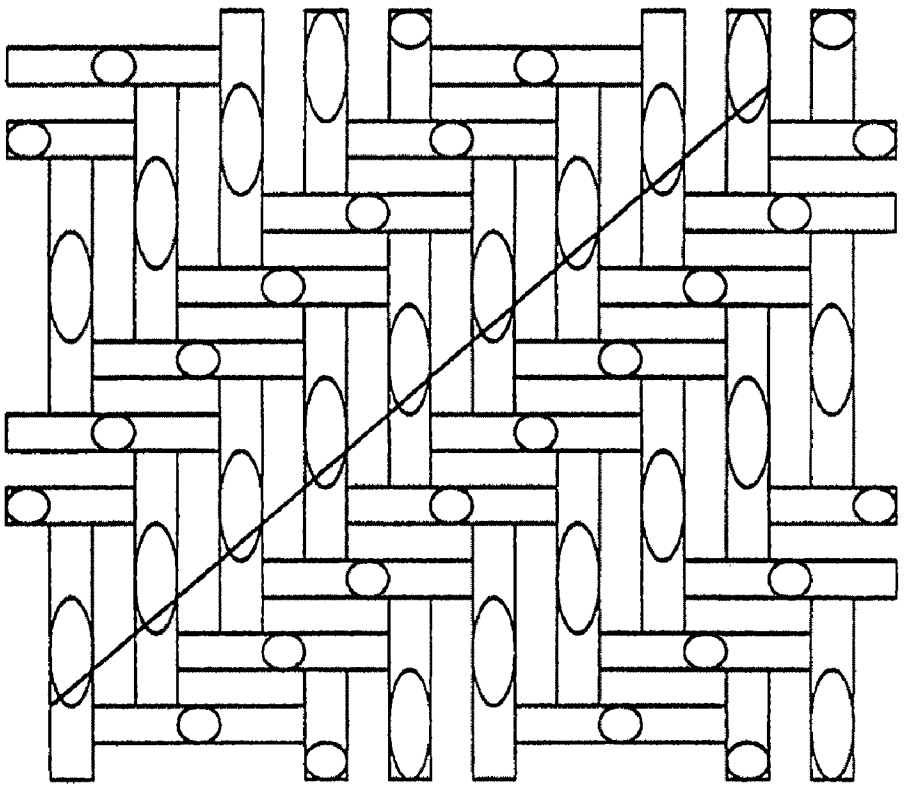
PRIOR ART Fig. 16B

Referring to FIG. 13, there is shown another embodiment of the present invention. This embodiment can be of the type disclosed in US 2007/0240842 to SCHERB et al., the disclosure of which is hereby expressly incorporated by reference in its entirety. As in previous embodiments, the machine preferably utilizes a structured fabric SF of the type shown in FIGS. 1 and 2.

The ATMOS system shown in FIG. 13 can include a headbox which feeds a suspension to a twin wire former formed by an outer wire, an inner wire and a forming roll. The twin wire former can be of any conventionally known type and can preferably be of the type disclosed in e.g., US Patent Application Publication No. 2006/0085999 (based on U.S. application Ser. No. 11/189,884 filed on Jul. 27, 2005), the disclosure of which is hereby expressly incorporated by reference in its entirety. Once the web W is formed by the twin wire former, the web W is conveyed by the inner wire to a structured fabric SF. The web W is transferred to the structured fabric SF from the inner wire using a suction box located at a pick-up area. The web W is conveyed by the structured fabric SF, of the type described above, to and through a pressing arrangement, e.g., formed by a belt press assembly composed of a permeable tension belt and a vacuum roll. A dewatering fabric can also pass over the vacuum roll and through the belt press assembly. The web W can be dewatered in an extended belt press nip, e.g., formed by the belt press assembly and the vacuum roll and may then be carried by the structured belt SF to a Yankee cylinder and hood arrangement, and can then be transferred to the Yankee using a press roll. A steam box and hot air blower arrangement may be arranged within the permeable tension belt and is arranged over a suction zone of the vacuum roll. One or more savealls can be utilized to collect moisture collected from the vacuum roll. The system can also utilize a number of guide rolls for each of the belts/fabrics, an adjusting roll for the dewatering belt, a number of Uhle boxes, a number of shower units, and an additional suction box or pick-up.

The structured fabric SF can preferably be an endless fabric which transports the web W to and from the belt press system, from the twin wire former, and to the Yankee cylinder for final drying. After being transferred from the twin wire former, the web W lies in the three-dimensional structure of the fabric SF, and therefore it is not flat but has also a three-dimensional structure, which produces a high bulky web.

By way of non-limiting example, the structured fabric SF can be a single or multi-layered woven fabric which can withstand the high pressures, heat, moisture concentrations, and which can achieve a high level of water removal and also mold or emboss the paper web required by the Voith ATMOS paper making process. The fabric SF should also have a width stability and a suitable high permeability. The fabric SF should also preferably utilize hydrolysis and/or temperature resistant materials.

The fabric SF is also preferably be utilized as part of a sandwich structure which includes at least two other belts and/or fabrics. These additional belts include a high tension belt and a dewatering belt. The sandwich structure is subjected to pressure and tension over an extended nip formed by a rotating roll or static support surface. The extended nip can have an angle of wrap of between approximately 30 degrees and approximately 180 degrees, and is preferably between approximately 50 degrees and approximately 130 degrees. The nip length can be between approximately 800 mm and approximately 2500 mm, and is preferably between approximately 1200 mm and approximately 1500 mm. The nip can be formed by a rotating suction roll having a diameter that is between approximately 1000 mm and approximately 2500 mm, and is preferably between approximately 1400 mm and approximately 1700 mm.

As explained above, the structured fabric SF imparts a topographical pattern into the paper sheet or web. To accomplish this, high pressures can be imparted to the fabric SF via a high tension belt. The topography of the sheet pattern can be manipulated by varying the specifications of the fabric SF, i.e., by regulating parameters such as, yarn diameter, yarn shape, yarn density, and yarn type. Different topographical patterns can be imparted in the sheet by different surface weaves. Similarly, the intensity of the sheet pattern can be varied by altering the pressure imparted by the high tension belt and by varying the specification of the fabric SF. Other factors which can influence the nature and intensity of the topographical pattern of the sheet include air temperature, air speed, air pressure, belt dwell time in the extended nip, and nip length.

The following are non-limiting characteristics and/or properties of the structured fabric SF: to enable suitable dewatering, the single or multi-layered fabric should have a permeability value of between approximately 100 cfm and approximately 1200 cfm, and is preferably between approximately 200 cfm and approximately 900 cfm; the fabric which is part of a sandwich structure with two other belts, e.g., a high tension belt and a dewatering belt, is subjected to pressure and tension over a rotating or static support surface and at an angle of wrap of between approximately 30 degrees and approximately 180 degrees and preferably between approximately 50 degrees and approximately 130 degrees; the fabric should have a paper surface contact area of between approximately 5% and approximately 70% when not under pressure or tension; the forming fabric should have an open area of between approximately 10% and approximately 90%.

The fabric SF is preferably a woven fabric that can be installed on an ATMOS machine as a pre-joined and/or seamed continuous and/or endless belt. Alternatively, the forming fabric SF can be joined in the ATMOS machine using e.g., a pin-seam arrangement or can otherwise be seamed on the machine. In order to resist the high moisture and heat generated by the ATMOS papermaking process, the woven single or multi-layered fabric SF may utilize either hydrolysis and/or heat resistant materials. Hydrolysis resistant materials should preferably include a PET monofilament having an intrinsic viscosity value normally associated with dryer and TAD fabrics in the range of between 0.72 IV (Intrinsic Velocity, i.e., a dimensionless number used to correlate the molecular weight of a polymer. The higher the number the higher the molecular weight) and approximately 1.0 IV and also have a suitable "stabilization package" which including carboxyl end group equivalents, as the acid groups catalyze hydrolysis and residual DEG or di-ethylene glycol as this too can increase the rate of hydrolysis. These two factors separate the resin which can be used from the typical PET bottle resin. For hydrolysis, it has been found that the carboxyl equivalent should be as low as possible to begin with, and should be less than approximately 12. The DEG level should be less than approximately 0.75%. Even at this low level of carboxyl end groups it is essential that an end capping agent be added, and should utilize a carbodiimide during extrusion to ensure that at the end of the process there are no free carboxyl groups. There are several classes of chemical than can be used to cap the end groups such as epoxies, ortho-esters, and isocyanates, but in practice monomeric and combinations of monomeric with polymeric carbodiimindes are the best and most used.

Heat resistant materials such as PPS can be utilized in the structured fabric SF. Other materials such as PEN, PBT, PEEK and PA can also be used to improve properties of the fabric such as stability, cleanliness and life. Both single polymer yarns and copolymer yarns can be used. The material for the fabric SF need not necessarily be made from monofilament and can be a multi-filament, core and sheath, and could also be a non-plastic material, i.e., a metallic material. Similarly, the fabric may not necessarily be made of a single material and can be made of two, three or more different materials. The use of shaped yarns, i.e., non-circular yarns, can also be utilized to enhance or control the topography or properties of the paper sheet. Shaped yarns can also be utilized to improve or control fabric characteristics or properties such as stability, caliper, surface contact area, surface planarity, permeability and wearability.

The structured fabric SF can also be treated and/or coated with an additional polymeric material that is applied by e.g., deposition. The material can be added cross-linked during processing in order to enhance fabric stability, contamination resistance, drainage, wearability, improve heat and/or hydrolysis resistance and in order to reduce fabric surface tension. This aids in sheet release and/or reduce drive loads. The treatment/coating can be applied to impart/improve one or several of these properties of the fabric. As indicated previously, the topographical pattern in the paper web can be changed and manipulated by use of different single and multi-layer weaves. Further enhancement of the pattern can be further attained by adjustments to the specific fabric weave by changes to the yarn diameter, yarn counts, yarn types, yarn shapes, permeability, caliper and the addition of a treatment or coating etc. Finally, one or more surfaces of the fabric or molding belt can be subjected to sanding and/or abrading in order to enhance surface characteristics.

The configurations of the individual yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of polypropylene, polyester, nylon, or the like. The skilled artisan should select a yarn material according to the particular application of the final fabric.

Regarding yarn dimensions, the particular size of the yarns is typically governed by the mesh of the papermaking surface. In a typical embodiment of the fabrics disclosed herein, preferably the diameter of the warp and weft yarns can be between about 0.10 and 0.50 mm. The diameter of the warp yarns can be about 0.45 mm, is preferably about 0.27 mm, and is most preferably about 0.35 mm. The diameter of the weft yarns can be about 0.50 mm, is preferably about 0.35 mm, and is most preferably about 0.42 mm. Those of skill in the art will appreciate that yarns having diameters outside the above ranges may be used in certain applications. In one embodiment of the present invention, the warp and weft yarns can have diameters of between about 0.13 mm, and 0.17 mm. Fabrics employing these yarn sizes may be implemented with polyester yarns or with a combination of polyester and nylon yarns.

It is noted that the foregoing examples have been provided merely for the purpose of explanation and are in no way to be construed as limiting of the present invention. While the present invention has been described with reference to exemplary embodiments, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular arrangements, materials and embodiments, the invention is not intended to be limited to the particulars disclosed herein. Instead, the invention extends to all functionally equivalent structures, methods and uses, such as are within the scope of the appended claims.

What is claimed:

1. A fabric for making a bulky web, comprising:
a machine facing side; and
a web facing side comprising pockets formed by more MD yarns than CD yarns,
wherein adjacent pockets are offset from each other, and
wherein the pockets are defined by MD and CD knuckles and the CD knuckles pass over two adjacent MD yarns.

2. The fabric of claim 1, wherein the bulky web comprises at least one of a tissue web, a hygiene web, and a towel web.

3. The fabric of claim 1, wherein the pockets are substantially equally sized rectangular pockets.

4. The fabric of claim 1, wherein a shape of the pockets is at least one of:
non square-shaped;
rectangular-shaped; and
four-sided.

5. The fabric of claim 1, wherein the MD yarns are warp yarns and the CD yarns are weft yarns.

6. The fabric of claim 1, wherein the fabric is a structured forming fabric.

7. The fabric of claim 1, wherein the fabric is a TAD fabric.

8. The fabric of claim 1, wherein the fabric is a crepe fabric.

9. The fabric of claim 1, wherein the fabric is a transfer fabric.

10. The fabric of claim 1, wherein the fabric is an E-TAD fabric.

11. The fabric of claim 1, wherein the fabric transfers a web to a Yankee roll.

12. The fabric of claim 1, wherein the fabric comprises a warp mesh of about 42, a weft count of about 36, a permeability of approximately 550 cfm, and a caliper of approximately 0.045 inches.

13. The fabric of claim 1, wherein the fabric comprises at least one of:

a single material;

a monofilament material;

a multifilament material; and two or more different materials.

14. The fabric of claim 1, wherein the fabric is resistant to at least one of hydrolysis and temperatures which exceed 100 degrees C.

15. The fabric of claim 1, wherein the fabric is an endless belt that is at least one of pre-seamed and has its ends joined on a machine which utilizes a belt press.

16. The fabric of claim 1, wherein the fabric is structured and arranged to impart a topographical pattern to a web.

17. A method of subjecting a web to pressing in a paper machine using the fabric of claim 1, the method comprising:

forming a web; and applying pressure to the fabric and the web.

18. The method of claim 17, wherein the paper machine comprises one of:

a TAD system;

an ATMOS system;

an E-TAD system; and a Metso system.

19. A method of making a web using the fabric of claim 1, the method comprising:

forming a web; and transferring the web to the fabric.

20. The method of claim 19, wherein the fabric is arranged on one of:

a TAD system;

an E-TAD system; and a system having a Yankee roll.

21. A fabric for making a bulky web, comprising:

a machine facing side; and a web facing side comprising pockets formed by more MD yarns than CD yarns, wherein adjacent pockets are offset from each other and are defined by MD and CD knuckles, and wherein a bottom of the pockets are formed by one CD yarn plainly weaving with plural MD yarns.

22. A fabric for making a bulky web, comprising:

a machine facing side; and a web facing side comprising pockets formed by more MD yarns than CD yarns, wherein adjacent pockets are offset from each other and are defined by MD and CD knuckles, and wherein a bottom of the pockets are formed by one CD yarn plainly weaving with three MD yarns.

23. The fabric of claim 22, wherein the MD knuckles are formed by passing a respective MD yarn over three adjacent CD yarns.

24. A fabric for making a bulky web, comprising:

a machine facing side; and a web facing side comprising pockets formed by more MD yarns than CD yarns, wherein adjacent pockets are offset from each other and are defined by MD and CD knuckles, and wherein the fabric utilizes a pattern repeat of eight MD yarns and eight CD yarns.

25. The fabric of claim 24, wherein six of the MD yarns of the pattern repeat passes over three adjacent CD yarns.

26. The fabric of claim 24, wherein two non-adjacent MD yarns of the pattern repeat pass over CD yarns 4-6, two other non-adjacent MD yarns of the pattern repeat pass over CD yarns 6-8, and two further non-adjacent MD yarns of the pattern repeat pass over CD yarns 2-4.

27. The fabric of claim 24, wherein none of the MD yarns of the pattern repeat plainly weaves with all eight CD yarns.

28. The fabric of claim 24, wherein MD yarns 1-3 and 5-7 of the pattern repeat each pass over three adjacent CD yarns.

29. The fabric of claim 24, wherein each MD yarns of the pattern repeat passes under four CD yarns.

30. A forming fabric for making a bulky web, comprising:

a web facing side comprises offset pockets formed by warp and weft yarns; and a contact plane of the web facing side comprises warp knuckles and weft knuckles, wherein the pockets are:

substantially rectangular on the contact plane of the web facing side; and defined by five warps yarns and three weft yarns.

31. The fabric of claim 30, wherein a bottom of the pockets comprises a different number of the warp and the weft yarns.

32. The fabric of claim 31, wherein the different number of the warp and the weft yarns comprises three warp yarns and one weft yarn.

33. A structured fabric for transferring the web to a Yankee roll, comprising:

a web facing side comprises pockets formed by warp and weft yarns;

a bottom of the pockets formed by a different number of warp and weft yarns; and a contact plane of the web facing side comprises warp and weft knuckles, wherein the pockets are elongate and substantially rectangular and are defined by five warps yarns and three weft yarns on the contact plane.

34. The fabric of claim 33, wherein the bottom of each pocket is formed by more warp yarns than weft yarns.

35. A paper making machine fabric comprising:

a woven fabric having a weave pattern which is regularly repeated over a surface;

weft yarns, warp yarns, and recesses or pockets which open upwardly to a paper supporting side of the fabric; and a bottom of each pocket being formed by a single weft yarn plainly weaving with plural warp yarns.

36. A paper making machine fabric comprising:

a woven fabric having a weave pattern repeating over a surface;

a pattern square for the repeating pattern containing eight warp yarns and eight weft yarns;

warp yarn 1 passes under weft yarns 1-2, over weft yarn 3, under weft yarns 4-5, and over weft yarns 6-8;

warp yarn 2 passes over weft yarn 1, under weft yarns 2-3, over weft yarns 4-6, and under weft yarns 7-8;

warp yarn 3 passes under weft yarn 1, over weft yarns 2-4, under weft yarns 5-6, over weft yarn 7, and under weft yarn 8;

warp yarn 4 passes over weft yarns 1-2, under weft yarns 3-4, over weft yarn 5, under weft yarns 6-7, and over weft yarn 8;

warp yarn 5 passes under weft yarns 1-2, over weft yarn 3, under weft yarns 4-5, and over weft yarns 6-8;

warp yarn 6 passes over weft yarn 1, under weft yarns 2-3, over weft yarns 4-6, and under weft yarns 7-8;

warp yarn 7 passes under weft yarn 1, over weft yarns 2-4, under weft yarns 5-6, over weft yarn 7, and under weft yarn 8; and warp yarn 8 passes over weft yarns 1-2, under weft yarns 3-4, over weft yarn 5, under weft yarns 6-7, and over weft yarn 8.

* * * * *